US006597881B2

(12) United States Patent
Hatori et al.

(10) Patent No.: US 6,597,881 B2
(45) Date of Patent: Jul. 22, 2003

(54) IMAGE FORMING APPARATUS

(75) Inventors: Satoshi Hatori, Kanagawa (JP); Takeshi Shintani, Kanagawa (JP); Shinichi Namekata, Kanagawa (JP); Shigekazu Enoki, Kanagawa (JP); Shinji Kato, Kanagawa (JP); Akinori Kobayashi, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/976,159

(22) Filed: Oct. 15, 2001

(65) Prior Publication Data

US 2002/0090230 A1 Jul. 11, 2002

(30) Foreign Application Priority Data

Oct. 16, 2000 (JP) ..... 2000-315441
Jan. 15, 2001 (JP) ..... 2001-006514

(51) Int. Cl.[7] ..... G03G 15/01; G03G 15/08
(52) U.S. Cl. ..... 399/227; 399/104; 399/260
(58) Field of Search ..... 399/104, 258, 399/259, 260, 262, 263, 226, 227

(56) References Cited

U.S. PATENT DOCUMENTS

| | | | | |
|---|---|---|---|---|
| 4,821,075 A | * | 4/1989 | Saito et al. | 399/227 X |
| 5,172,169 A | | 12/1992 | Takashima et al. | |
| 5,220,383 A | | 6/1993 | Enoki et al. | |
| 5,227,842 A | | 7/1993 | Hayashi et al. | |
| 5,239,344 A | | 8/1993 | Enoki et al. | |
| 5,245,391 A | | 9/1993 | Suzuki et al. | |
| 5,270,783 A | | 12/1993 | Bisaiji et al. | |
| 5,286,918 A | | 2/1994 | Iwata et al. | |
| 5,311,263 A | | 5/1994 | Suzuki et al. | |
| 5,384,628 A | | 1/1995 | Takami et al. | |
| 5,389,733 A | | 2/1995 | Enoki et al. | |
| 5,394,231 A | | 2/1995 | Sudo et al. | |
| 5,451,713 A | | 9/1995 | Suzuki et al. | |
| 5,474,869 A | | 12/1995 | Tomita et al. | |
| 5,508,794 A | | 4/1996 | Ikesue et al. | |
| 5,552,864 A | * | 9/1996 | Malicki et al. | 399/104 |
| 5,552,877 A | | 9/1996 | Ishikawa et al. | |
| 5,617,189 A | * | 4/1997 | De Cock et al. | 399/259 X |
| 5,617,198 A | | 4/1997 | Ishikawa et al. | |
| 5,627,630 A | | 5/1997 | Matsumae et al. | |
| 5,640,654 A | * | 6/1997 | Yoshizawa | 399/227 |
| 5,646,721 A | | 7/1997 | Sugihara et al. | |
| 5,657,115 A | | 8/1997 | Sugihara | |

(List continued on next page.)

FOREIGN PATENT DOCUMENTS

| | | |
|---|---|---|
| JP | 01-191156 | 8/1989 |
| JP | 06-194947 | 7/1994 |
| JP | 06-236112 | 8/1994 |
| JP | 2000-056568 | 2/2000 |
| JP | 2000-250314 | 9/2000 |

*Primary Examiner*—Sandra Brase
(74) *Attorney, Agent, or Firm*—Oblon, Spivak, McClelland, Maier & Neustadt, P.C.

(57) ABSTRACT

An image forming apparatus of the present invention includes an image carrier. A rotary developing device adjoins the image carrier and includes a plurality of developing sections for developing a latent image formed on the image carrier with a magnetic developer. A toner cartridge unit includes a plurality of toner cartridges and is rotatable integrally with the developing device. A plurality of toner conveying device each connect one toner cartridge to the associated developing section and each include a toner passage and a toner conveying member disposed in the toner passage. A magnet adjoins a toner outlet, which is formed in the toner passage and communicated to the developing section, for forming a magnetic field that traverses the toner passage over the entire diameter of the toner passage. Toner stored in each toner cartridge is prevented from unexpectedly flowing into the associated developing section when replenishment is not effected.

16 Claims, 19 Drawing Sheets

U.S. PATENT DOCUMENTS 5,671,470 A 9/1997 Maruta et al.
5,674,408 A 10/1997 Suzuki et al.
5,724,634 A 3/1998 Maruta
5,741,616 A 4/1998 Hirano et al.
5,758,235 A 5/1998 Kosuge et al.
5,765,059 A 6/1998 Kosuge et al.
5,768,664 A 6/1998 Kosuge et al.
5,784,669 A 7/1998 Miura et al.
5,787,328 A 7/1998 Sugihara et al.
5,819,145 A 10/1998 Tanaka et al.
5,826,146 A 10/1998 Maruta et al.
5,835,825 A 11/1998 Maruta
5,850,586 A 12/1998 Sugihara et al.
5,852,759 A * 12/1998 Vackier et al. ..... 399/260
5,860,038 A 1/1999 Kato et al.
5,864,733 A 1/1999 Mae et al.
5,881,334 A 3/1999 Maruta et al.
5,915,155 A 6/1999 Shoji et al.
5,940,664 A 8/1999 Sugihara et al.
5,959,549 A 9/1999 Synesiou et al.
5,970,276 A * 10/1999 Kato
5,991,569 A 11/1999 Sugihara et al.
6,055,386 A 4/2000 Kato et al.
6,070,037 A 5/2000 Sugihara et al.
6,072,967 A 6/2000 Sugihara et al.
6,081,678 A * 6/2000 Kato
6,104,900 A 8/2000 Ishikawa et al.
6,122,469 A * 9/2000 Miura et al.
6,125,243 A * 9/2000 Shoji et al.
6,141,520 A * 10/2000 Kosuge
6,160,569 A 12/2000 Fujimori et al.
6,226,481 B1 5/2001 Yoneda et al.
6,336,020 B1 1/2002 Ishikawa et al.

* cited by examiner

IMAGE FORMING APPARATUS

BACKGROUND OF THE INVENTION

1. Field of the Invention

The present invention relates to a copier, facsimile apparatus, printer or similar image forming apparatus and more particularly to an image forming apparatus of the type using a revolver or rotary developing device.

2. Description of the Background Art

An image forming apparatus of the type using a revolver as a developing device is conventional. The revolver includes a rotary developing unit adjoining an image carrier and having a plurality of developing sections arranged therein. A toner storing unit is rotatable integrally with the developing unit and has a plurality of toner chambers corresponding one-to-one to the developing sections of the developing unit. A plurality of toner conveying means each connect one toner chamber to the associated developing section. This type of image forming apparatus is disclosed in, e.g., Japanese Patent Laid-Open Publication Nos. 62-251772 and 63-78170 and Japanese Utility Model Laid-Open Publication No. 63-41164. Each toner conveying means includes a toner passage extending between the toner chamber and the developing section and a toner conveying member disposed in the toner passage. The toner conveying means conveys fresh toner from the toner chamber to the developing section, as needed.

As for the toner conveying member, Japanese Utility Model Laid-Open Publication No 3-129968 and Japanese Patent Application No. 4-345373, for example, each teach a screw made up of a shaft and a spiral blade formed on the shaft. Such a toner conveying member is capable of conveying toner from a toner chamber to a remote place along, e.g., a toner pipe. This enhances the free layout of the individual unit of the image forming apparatus, e.g., allows each toner chamber to be positioned not on the top, but on the side of the associated developing section, while contributing to the miniaturization of the apparatus.

A certain clearance is formed between the screw and the toner pipe, so that the screw can smoothly rotate. If the clearance is absent, then the screw and toner pipe are apt to produce noise due to interference or lock up when the screw is driven to rotate. The clearance, however, brings about the following problems.

First, the toner whose fluidity increases due to the rotation of the revolver rushes into the toner pipe and flows into the developing section via the clearance. Second, even when the fluidity of the toner is not high, the toner rushed into the toner pipe makes it difficult for air inside the toner pipe to escape. The resulting air pressure forces the toner out of the toner pipe toward the developing section side. Third, part of the toner adjoining a toner outlet, which is formed in the toner pipe and faces the developing section, flows into the developing section due to vibration ascribable to the rotation of the revolver. In any case, the toner unexpectedly flown out of the toner pipe enters the developing section without regard to a toner replenish signal to be output from the apparatus body. If the toner flows out of the toner pipe in an amount greater than one to be consumed, then it increases the toner content of a developer stored in the developing section, resulting in excessively high image density and background contamination. Moreover, such toner increases the volume of toner present in the developing section and causes the developing section to lock up.

In light of the above, Japanese Patent Laid-Open Publication No. 2000-56568, for example, discloses an image forming apparatus including a revolver operable with a magnetic developer. A plurality of toner cartridges are removably mounted to the revolver in one-to-one correspondence to developing sections arranged in the revolver. The toner cartridges are rotatable integrally with the revolver. A plurality of toner conveying means each include a toner passage connecting one of the toner cartridges to the associated developing section and a toner conveying member. Magnetic field forming means is provided on the toner passage in the vicinity of a toner outlet, which is formed in the toner passage and communicated to the developing section. The magnetic field forming means forms a magnetic field that causes the magnetic developer, which flows out of the developing section into the toner passage when the revolver rotates, to form a magnet brush around the toner outlet. The magnet brush seals the toner outlet to thereby prevent the toner from flowing into the developing section. The magnet brush, however, cannot fully seal the toner outlet.

Generally, the rotation speed of the revolver is varied in accordance with the number of images to be formed. In a high-speed machine, for example, the revolver is caused to rotate at a higher speed than in an ordinary machine. The rotation speed of the revolver presumably has influence on the amount of toner to unexpectedly flow out of the toner passage into the developing section. Further, the current trend in the imaging art is toward the use of toner having high fluidity, i.e., low cohesiveness for enhancing image quality. Toner with low cohesiveness is rapidly mixed with a developer and rapidly stabilizes the characteristics of the developer. Presumably, the cohesiveness of toner also has influence on the amount of toner to unexpectedly flow into the developing section.

It is therefore necessary to clear up the influence of the rotation speed of the revolver or the cohesiveness of toner on the amount of toner to unexpectedly flow into the developing section to thereby obviate the unexpected outflow of the toner. It is also necessary to promote accurate prevention of the unexpected outflow of the toner.

Technologies relating to the present invention are also disclosed in, e.g., Japanese Patent Laid-Open Publication Nos. 6-194947, 6-236112 and 2000-250314 and Japanese Patent No. 2,935,114.

SUMMARY OF THE INVENTION

It is an object of the present invention to provide an image forming apparatus capable of preventing toner from unexpectedly flowing out of a toner cartridge into a developing section and thereby insuring high image quality.

An image forming apparatus of the present invention includes an image carrier. A rotary developing device adjoins the image carrier and includes a plurality of developing sections for developing a latent image formed on the image carrier with a magnetic developer. A toner cartridge unit includes a plurality of toner cartridges and is rotatable integrally with the developing device. A plurality of toner conveying device each connect one toner cartridge to the associated developing section and each include a toner passage and a toner conveying member disposed in the toner passage. A magnet adjoins a toner outlet, which is formed in the toner passage and communicated to the developing section, for forming a magnetic field that traverses the toner passage over the entire diameter of the toner passage. Toner stored in each toner cartridge is prevented from unexpectedly flowing into the associated developing section when replenishment is not effected.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

To better understand the present invention, brief reference will be made to the image forming apparatus taught in previously mentioned Japanese Patent Laid-Open Publication No. 2000-56568, shown in FIG. 1. Briefly, the image forming apparatus taught in this document includes magnetic field forming means positioned on the toner passage of toner conveying means in the vicinity of a toner outlet, as stated earlier. The magnetic field forming means causes a developer to form a magnet brush and seal the toner outlet of the toner passage.

Figure 1:
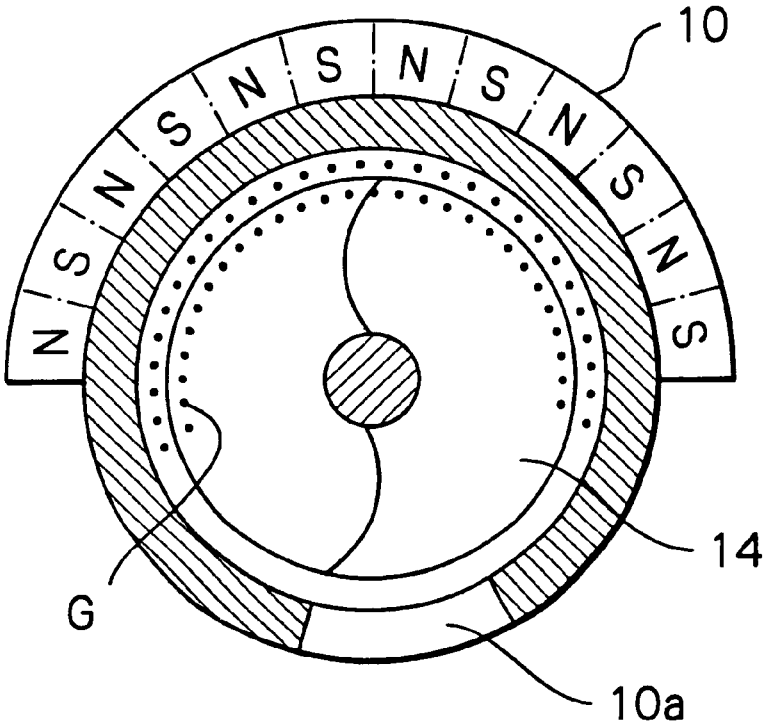
Fig. 1 PRIOR ART
FIG. 1 is a fragmentary section showing conventional magnetic field forming means.

Specifically, as shown in FIG. 1, the magnetic field forming means is implemented by a magnet 12 having multiple magnetic poles. The magnet 12 surrounds part of the circumference of a toner pipe 10 that faces a toner outlet 10*a* formed in the wall of the toner pipe 10. A screw 14 is disposed in the toner pipe 10. The magnet 12 has N poles and S poles alternating with each other in the circumferential direction of the toner pipe 10.

Figure 2:
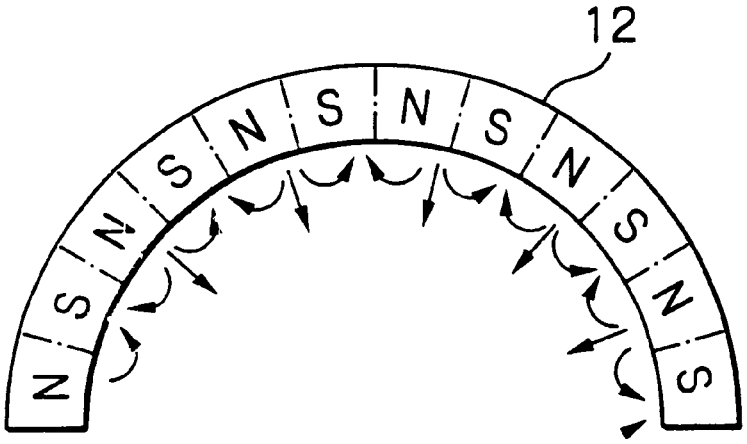
Fig. 2 PRIOR ART
FIG. 2 shows magnetic lines of force extending out from the magnetic field forming means of FIG. 1.

As shown in FIG. 2, each magnetic line of force output from a particular pole of the magnet 12 is input to another pole just next to the above pole without being directed toward the axis of the toner pipe 10. As a result, as shown in FIG. 1, a developer G is simply retained on the inner periphery of the pipe 10 in the form of a thin layer along the magnetic lines of force. In this condition, the developer G cannot sufficiently seal the toner outlet 10*a* and is likely to cause toner to unexpectedly flow into a developing section, which is fluidly communicated to the outlet 10*a*.

Figure 3:
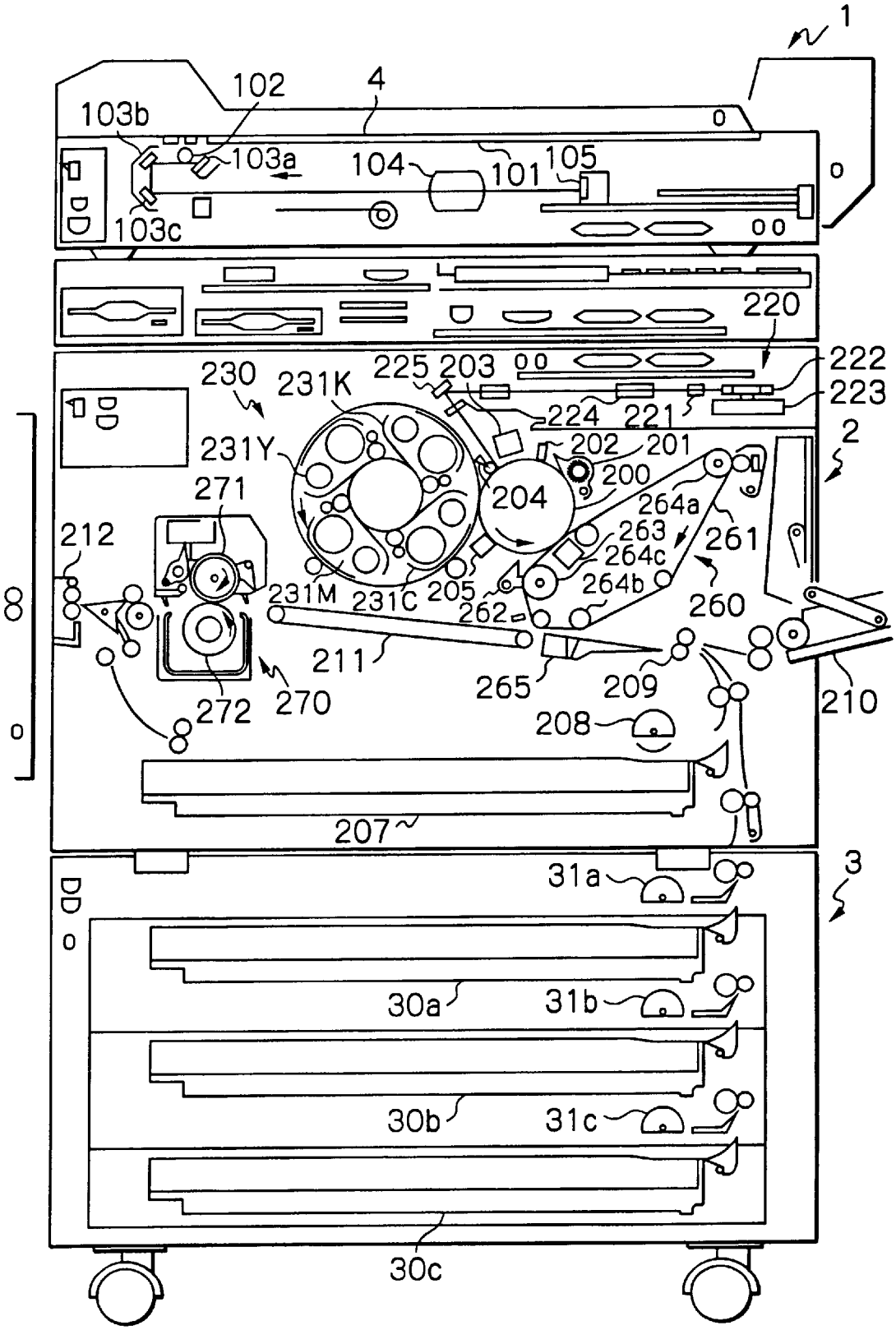
FIG. 3 is a front view showing an image forming apparatus embodying the present invention.

Referring to FIG. 3, an image forming apparatus embodying the present invention is shown and implemented as an electrophotographic color copier by way of example. As shown, the color copier is generally made up of a color scanner or color image reading device 1, a color printer or color image recording device, and a sheet bank 3.

The color scanner 1 includes a lamp 102 for illuminating a document 4 laid on a glass platen 101. The resulting imagewise reflection from the document 4 is incident to a color image sensor 105 via mirrors 103*a*, 10*b* and 103*c* and a lens 104. The color image sensor 105 therefore reads the color image information of the document 4 as separated colors, e.g., red (R), green (G) and blue (B) while converting each of them to a particular image signal. In the illustrative embodiment, the color image sensor 105 includes R, G and B color separating means and a CCD (Charge Coupled Device) image sensor or similar image sensor and reads images of three different colors at the same time. An image processing section, not shown, transforms the R, G and B image signals to black (Bk), cyan (C), magenta (M) and yellow (Y) image data on the basis of signal intensity.

More specifically, in response to a scanner start signal synchronous to the operation of the color printer 2, which sill be described later, optics including the lamp 102 and mirrors 103*a* through 103*c* starts moving to the left, as viewed in FIG. 3, to thereby scan the document 4. Every time the optics scans the document 4, the color image sensor 105 outputs image data of one color. The color image sensor 105 therefore sequentially outputs image data of four colors as the optics repeatedly scans the document 4 four consecutive times. The color printer 2 forms a particular toner image in accordance with each of the image data of four colors. Such toner images are sequentially superposed to complete a four-color or full-color image.

The color printer 2 includes a photoconductive drum 200 or image carrier 200, an optical writing device 220, a revolver or rotary developing device 230, an intermediate image transferring device 260, and a fixing device 270. The drum 200 is rotatable counterclockwise, as viewed in FIG. 3. A drum cleaner 201, a quenching lamp or discharge lamp 202, a charger 203 and a potential sensor 204 are arranged around the drum 200. Also positioned around the drum 200 are one of developing sections arranged in the revolver 230, a density pattern sensor 205, and a belt 261 included in the intermediate image transferring device 260.

The optical writing unit 220 transforms the color image data output from the color scanner 1 to an optical signal and scans the surface of the drum 200 with the optical signal, thereby forming a latent image on the drum 200. Specifically, the writing unit 220 includes a semiconductor laser or light source 221, a laser driver, not shown, a polygonal mirror 222, a motor 223 for driving the mirror 222, an f/θ lens 224, and a mirror 225.

The revolver 230 includes a Bk developing section 231K, a C developing section 231, an M developing section 231M, and a Y developing section 231Y. A driveline, which will be described later, causes the revolver 230 to bodily revolve counterclockwise, as viewed in FIG. 3. The developing sections 231 through 231Y each include a sleeve and a paddle. The sleeve rotates while causing a developer deposited thereon to contact the drum 200 and develop the latent image. The paddle rotates to scoop up the developer onto the sleeve while agitating the developer. The developer consists of toner and magnetic carrier. The toner is charged to negative polarity by being agitated together with the carrier. A bias power source, not shown, applies a bias for development to the sleeve in order to bias the sleeve to a preselected potential with respect to the metallic base layer of the drum 200. In the illustrative embodiment, the bias is implemented by a negative DC voltage Vdc biased by an AC voltage Vac.

When the color copier is in a stand-by state, the revolver 230 is held in a halt with its Bk developing section 231K facing the drum 200 at a preselected developing position, as illustrated. On the start of a copying operation, the color scanner 1 starts reading Bk image data out of the document 4 at a preselected time while the laser optics starts scanning the drum 200 in accordance with the Bk image data. Let a latent image derived from the Bk image data be referred to as a Bk latent image. This is also true with the other colors C, M and Y. The Bk sleeve starts rotating before the leading edged of the Bk latent image arrives at the developing position in order to develop the leading edge to the trailing edge of the Bk latent image. The Bk sleeve develops the Bk latent image with Bk toner. When the trailing edge of the Bk latent image moves away from the developing position, the revolver 230 rotates in order to immediately bring the next developing section to the developing position. This rotation completes at least before the leading edge of the next latent image arrives at the developing position. The revolver 230 will be described in detail later.

The intermediate image transferring device 260 includes a belt cleaner 262, a corona discharger or primary image transferring unit 263 in addition to the previously mentioned belt 261. The belt 261 is passed over a drive roller 264*a*, rollers 264*b* and 264*c*, and a plurality of driven rollers. A motor, not shown, causes the belt 361 to turn in a direction indicated by an arrow in FIG. 3. The belt cleaner 262 includes an inlet seal, a rubber blade, a discharge coil, and mechanisms for moving the inlet seal and rubber blade into and out of contact with the belt 261. After the transfer of a Bk toner image or first-color toner image from the drum 200 to the belt 261, the above mechanisms maintain the inlet seal and rubber blade spaced from the belt 261 during the transfer of the second-, third- and fourth-color toner images. Let the image transfer from the drum 200 to the belt 261 be referred to as primary image transfer.

The first- to fourth-color toner images are sequentially transferred from the drum 200 to the belt 261 one above the other, completing a full-color toner image, as stated earlier. A corona discharger or secondary image transferring unit 265 collectively transfers the full-color image from the belt 261 to a paper sheet or similar recording medium. This image transfer will be referred to as secondary image transfer hereinafter.

A sheet cassette 207 is disposed in the color printer 2 while sheet cassettes 300*a*, 300*b* and 300*c* are disposed in the sheet bank 3. The sheet cassettes 207 and sheet cassettes 300*a* through 300*c* each are loaded with a stack of paper sheets of particular size. Pick up rollers 208, 301*a*, 301*b* and 301*c* are associated with the sheet cassettes 207, 300*a*, 300*b* and 300*c*, respectively. One of the pickup rollers 208 and 301*a* through 301*c* pays out the paper sheet from associated one of the sheet cassettes 207 and 300*a* through 300*c* toward a registration roller pair 209. A manual feed tray 210 is mounted on the right side wall of the printer 2, so that the operator of the copier can feed, e.g., OHP films or thick sheets by hand.

In operation, on the start of an image forming cycle, the drum 200 and belt 261 start rotating counterclockwise and clockwise, respectively, as viewed in FIG. 3. A Bk toner image, a C toner image, an M toner image and a Y toner image are sequentially formed on the drum 200 while being sequentially transferred to the belt 261 one above the other.

More specifically, while the drum 200 is in rotation, the charger 203 uniformly charges the surface of the drum 200 to about −700 V. The semiconductor laser 221 scans the charged surface of the drum 200 in accordance with a Bk image signal by raster scanning. As a result, the uniform charge deposited on the drum 200 is lost in the exposed portions of the drum 200 in proportion to the quantity of incident light, forming a Bk latent image. Negatively charged Bk toner deposited on the Bk sleeve contacts the Bk latent image in the exposed portions of the drum 200, forming a corresponding Bk toner image. The primary image transferring unit 263 transfers the Bk toner image from the drum 200 to the belt 261, which is running at the same speed as the drum 200 in contact with the drum 200.

The drum cleaner 201 removes some toner left on the drum 200 after the primary image transfer. The toner collected by the drum cleaner 201 is delivered to a waste toner tank, not shown, via a collection pipe.

After the Bk image forming step, a C image forming step begins and causes the color scanner 1 to start reading C image data out of the document 4 at a preselected time. The laser optics forms a C latent image in accordance with the C image data. The revolver 230 rotates to bring the C developing section 231C to the developing position after the trailing edge of the Bk latent image has moved away from the developing position, but before the leading edge of the C latent image arrives at the same. In this condition, the C developing section 231C develops the C latent image with C toner to thereby form a C toner image. Subsequently, the revolver 230 again rotates just after the trailing edge of the C latent image has moved away from the developing position, locating the M developing section 231M at the developing position. This also completes before the leading edge of the next or M latent image arrives at the developing position.

An M and a Y image forming step are identical with the Bk and C image forming steps as to color image data reading, latent image formation and development and will not be described specifically in order to avoid redundancy.

At the time when the image forming operation described above begins, a sheet fed from any one of the sheet cassettes 207 and 300*a* through 300*c* or the manual feed tray 210 is stopped by the registration roller pair 209. The registration roller pair 209 starts conveying the sheet at such a timing that the leading edge of the sheet meets the leading edge of the full-color image formed on the belt 261 at the secondary image transferring unit 265. The sheet and full-color image therefore arrive at the secondary image transferring unit 265, which is biased to positive polarity, while being superposed on each other. At this instant, the secondary image transferring unit 265 charges the sheet to a positive potential by corona discharge, so that the full-color image is almost entirely transferred from the belt 261 to the sheet. A corona discharger, not shown, following the image transferring unit 265 and applied with an AC-biased DC voltage separates the sheet from the belt 261. Consequently, the sheet is handed over from the belt 261 to a belt conveyor 211.

The belt conveyor 261 conveys the sheet carrying the full-color image thereon to the fixing device 270, which includes a heat roller 271 heated to a preselected temperature and a press roller 272 pressed against the heat roller 271. The heat roller 271 and press roller 272 fix the toner image on the sheet being conveyed through their nip with heat and pressure. The sheet coming out of the fixing device 270 is driven out of the copier body to a copy tray, not shown, by an outlet roller pair 212 face up.

After the primary image transfer, the drum cleaner 201 (brush roller or rubber blade) cleans the surface of the drum 200. Subsequently, the quenching lamp 202 uniformly discharges the surface of the drum 200 to thereby prepare the drum 200 for the next image formation. Likewise, the belt cleaner 262 cleans the surface of the belt 261 with its rubber blade being again brought into contact with the belt 261.

In a repeat copy mode, as for the color scanner 1 and drum 200, the Bk or first-color image forming step for the second sheet begins at a preselected time after the fourth-color or Y image forming step executed with the first sheet. As for the belt 261, after the secondary transfer of the full-color image to the first sheet, a Bk toner image for the second color is transferred from the drum 200 to the area of the belt 261 cleaned by the belt cleaner 262.

In a tricolor or a bicolor copy mode, the operation described above is repeated a number of times corresponding to the number of desired colors and the number of desired prints. Further, in a monocolor copy mode, one of the developing sections of the revolver 230 corresponding to a desired color is held at the developing position until a desired number of prints have been output. In this case, the blade of the belt cleaner 262 is continuously pressed against the belt 261.

As for an A4 size, full-color copy mode, it is preferable to form a toner image of one color for each turn of the belt 261, i.e., to form toner images of four colors for four turns of the belt 261. However, it is more preferable to form a toner image of one color for two turns of the belt 261 in order to reduce the overall size of the copier, i.e., to reduce the length of the belt 261. This configuration implements a copy speed feasible for a small sheet size without lowering a copy speed assigned to the maximum sheet size. In this case, after the transfer of a Bk toner image from the drum 200 to the belt 261, the belt 261 makes an idle turn without the color printer 2 effecting development or image transfer. During the next turn of the belt 261, a C toner image is formed and then transferred to the belt 261. The revolver 230 is caused to rotate during the idle turn of the belt 261.

Figure 4A:
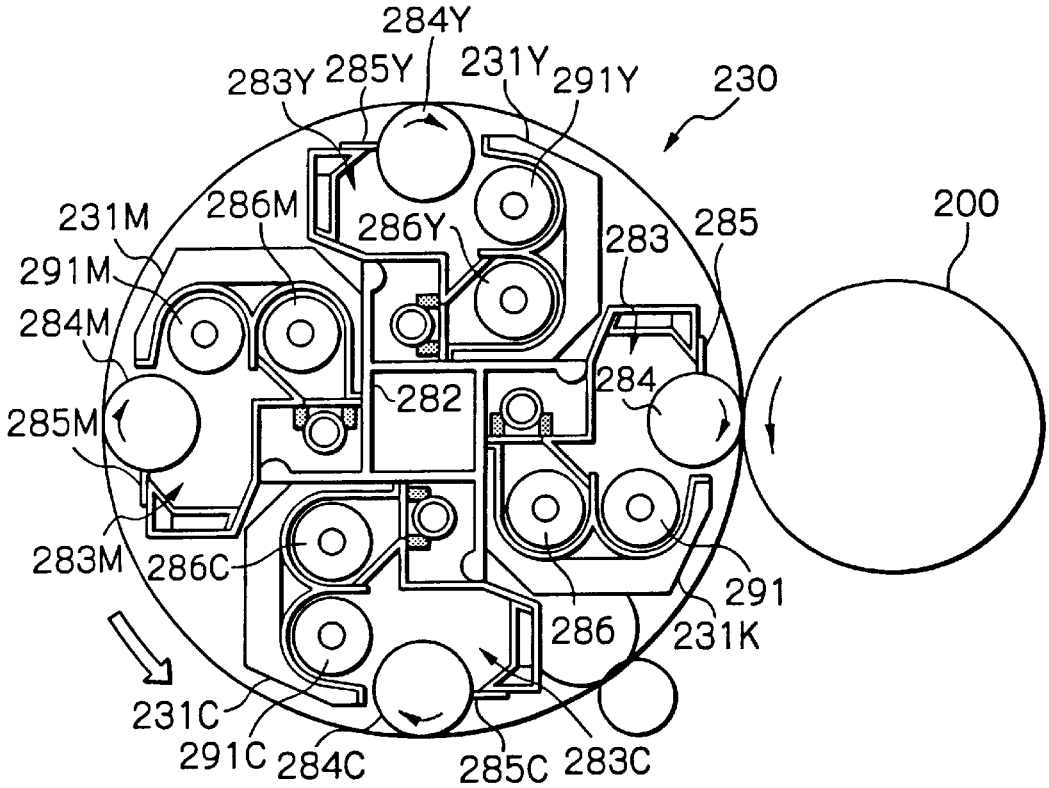
FIG. 4A is a section showing a revolver or rotary developing device included in the illustrative embodiment.
Figure 4B:
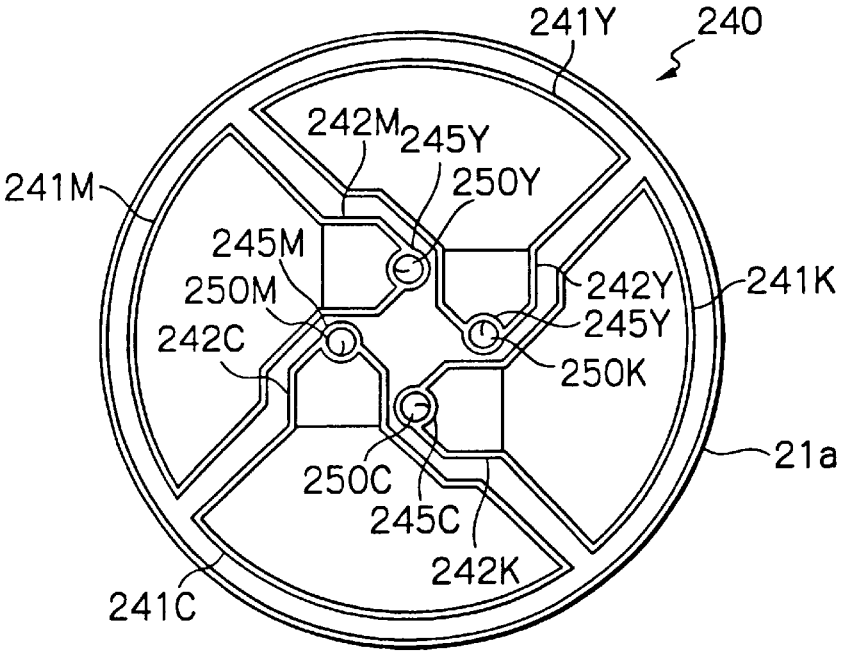
FIG. 4B is a section of the revolver.
Figure 5:
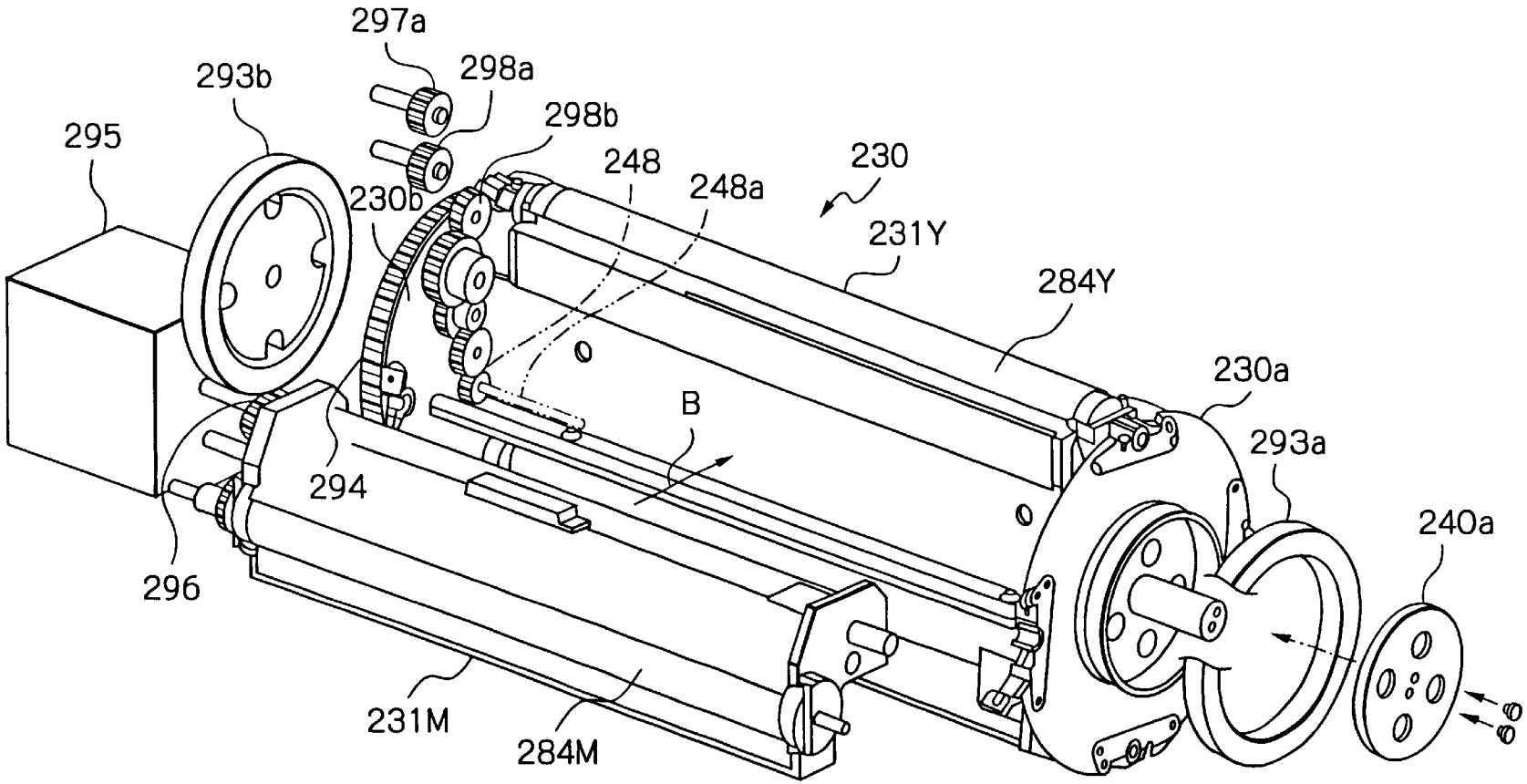
FIG. 5 is an isometric view of the revolver.

Reference will be made to FIGS. 4A and 5 for describing the revolver 230. As shown in FIG. 5, the developing section 231Y, for example, includes a hollow, rectangular stay and a front and a rear end plate 230*a* and 230*b* mounted on opposite ends of the stay. As shown in FIG. 4A, the developing sections 231K, 231C, 231M and 231Y further include casings 283K, 283C, 283M and 283Y, respectively, which are identical in configuration with each other. The casings 283K through 283Y each store a two-ingredient type developer, i.e., a mixture of toner of particular color and magnetic carrier. In the specific condition shown in FIG. 4A, the Bk developing section 231K storing black toner and magnetic carrier is located at the developing position where it faces the drum 200. The Y developing section 231Y, M developing section 231M and C developing section 231C are sequentially positioned in this order in the counterclockwise direction, as viewed in FIG. 4.

The developing sections 231K through 231Y are identical in configuration with each other except for the color of toner. The following description will therefore concentrate on the Bk developing section 231K located at the developing position by way of example. The components of the other developing sections 231C, 231M and 231Y will be simply distinguished from the components of the developing section 231K by suffixes C, M and Y.

The casing 283 of the developing section 231K is formed with an opening facing the drum 200. A developing roller 284 is disposed in the casing 283 and partly exposed to the outside through the above opening. The developing roller or developer carrier 284 is made up of a sleeve and a magnet roller accommodated in the sleeve. A doctor blade or metering member 285 reduces the amount of the developer to be conveyed to the developing position by the developing roller 284. A first screw 286 convey the developer removed by the doctor blade 285 and confined in the casing 283 from the rear to the front in its axial direction while agitating it. A second screw 291 conveys the developer from the front to the rear in its axial direction while agitating it. A toner content sensor, not shown, is mounted on the casing 283 below the second screw 291 for sensing the toner content of the developer stored in the casing 283.

Figure 6:
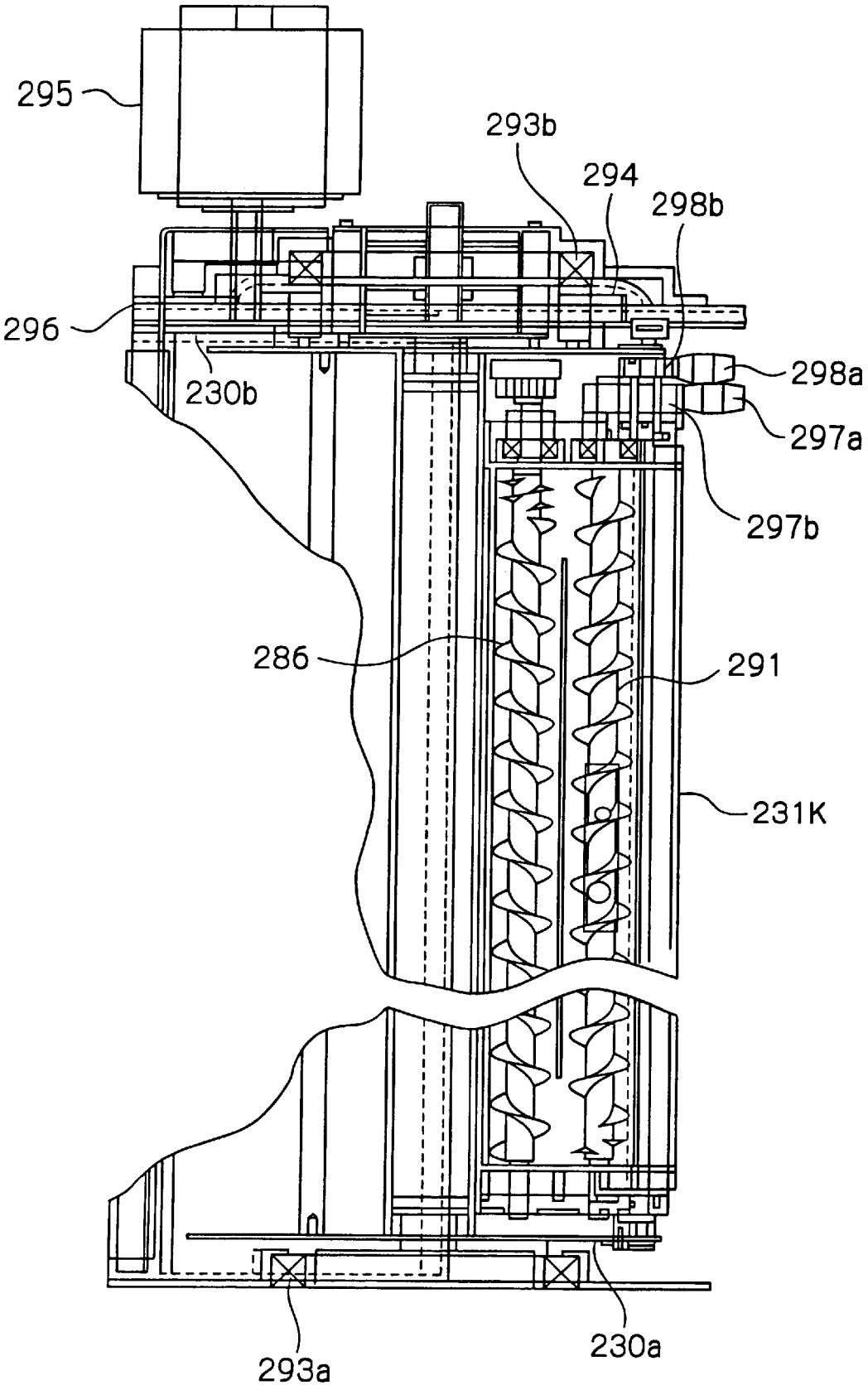
FIG. 6 is a plan view showing a toner conveying section and a driveline included in the revolver.

FIG. 6 is a vertical section in a plane containing the axes of the two screws 286 and 291. As shown, the screws 286 and 291 in rotation circulate the developer in the casing 283 while agitating it. When the sleeve of the developing roller 284 is caused to rotate, it conveys the developer deposited thereon to the developing position via the doctor blade 285. At the developing position, the toner of the developer is transferred from the sleeve to the drum 200.

Figure 7:
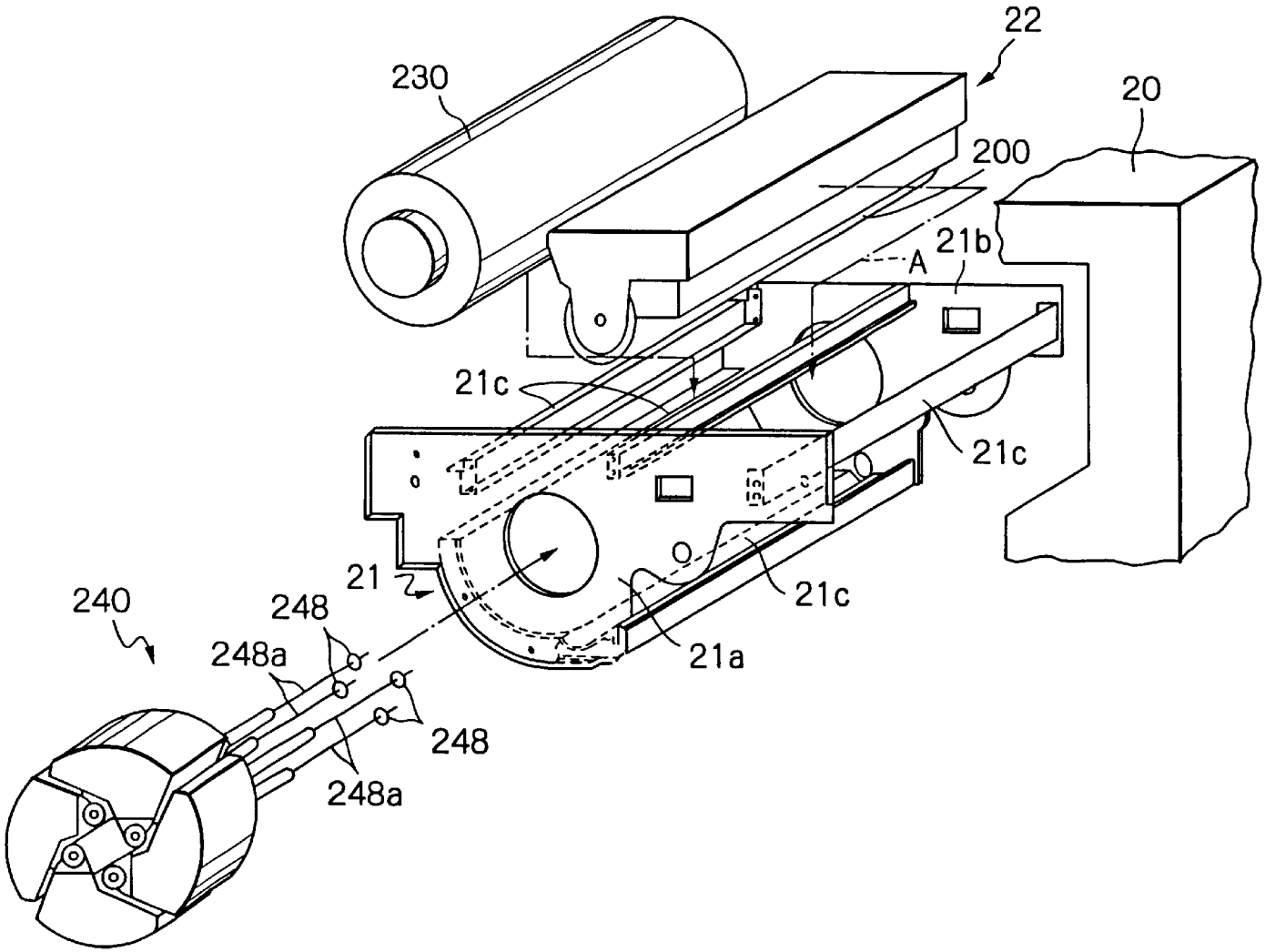
FIG. 7 is a perspective view showing a support pulled out of the apparatus body.

As shown in FIG. 7, the revolver 230 is mounted on a slidable support 21, which can be pulled out of the copier body, as needed. The support 21 additionally supports a drum unit or image carrier unit 22 including the drum 200. Specifically, the drum unit 22 is mounted to the support 21 in a direction indicated by an arrow A in FIG. 7.

The support 21 is made up of a front plate 21*a*, a rear plate 21*b* and a right, a left, a center, a top and a bottom stay member 21*c*. Slide rails, not shown, are mounted on opposite sides of the support 2 and allow the support 2 to be pulled out toward the front of the copier body.

As shown in FIG. 5, the developing sections each are movably mounted to a support member included in the revolver 230 and supported by the support 21. More specifically, each developing section is mounted to the above support member in a direction indicated by an arrow B in FIG. 5. The support 21 is configured such that it can be pulled out of the copier body by more than its entire length in order to fully expose the developing sections of the revolver 230.

Figure 8:
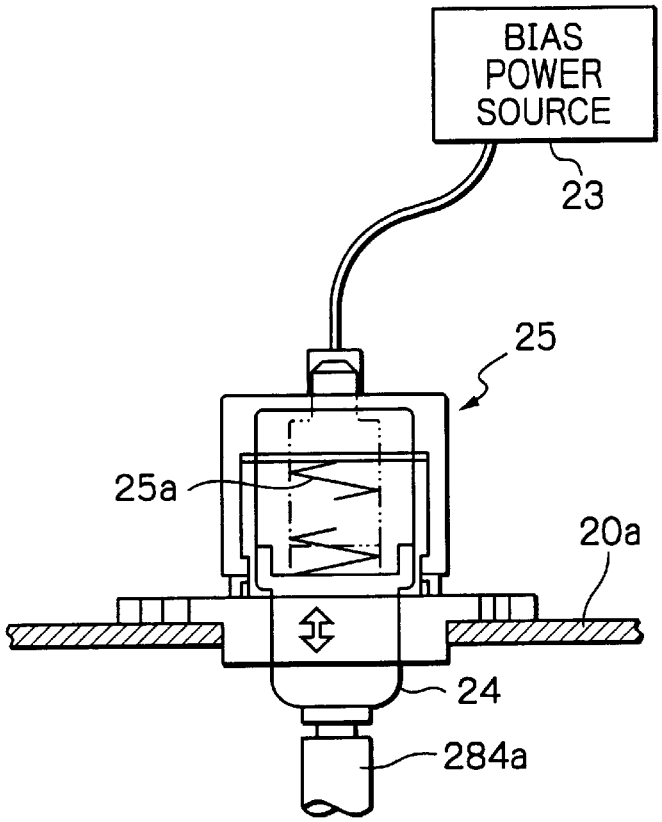
FIG. 8 is a fragmentary section showing a mechanism for applying a bias for development to a developing section included in the revolver.
Figure 9:
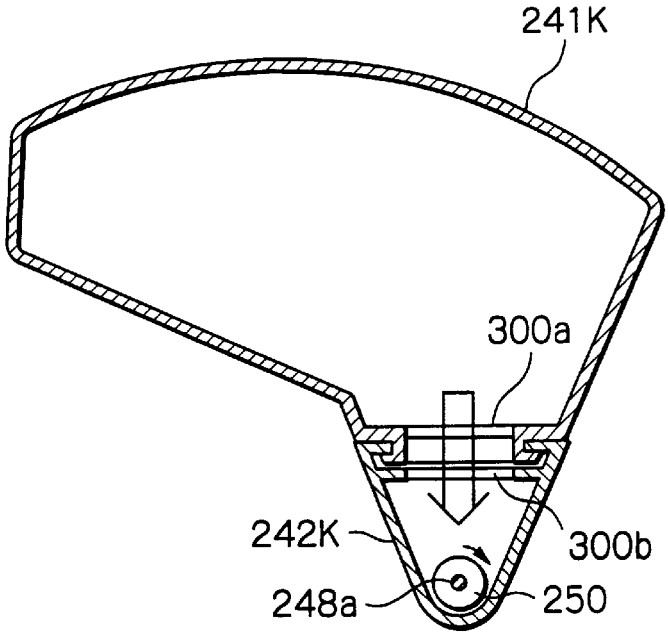
FIG. 9 is a section showing a toner cartridge unit included in the revolver.

As shown in FIG. 8, the developing section located at the developing position includes a bias input portion implemented by the shaft 284*a* of the developing roller 284. A color printer body 20 includes a rear wall. A rod-like bias terminal 23 is mounted on the rear wall 20*a* via a bracket 25 and connected to a bias power source 23 for development. The bias terminal 24 is retractable in the direction of slide or thrust of the support 21. A conductive spring or biasing means 25*a* constantly biases the terminal member 24 toward the front of the copier body. The bias terminal 24 has a hemispherical tip. On the other hand, the shaft 284*a* of the developing roller 284 has an end formed with a recess having an arcuate section that is slightly greater in radius of curvature than the hemispherical tip of the bias terminal 24. In this configuration, the end of the shaft 284*a* can stably contact the tip of the bias terminal 24 with a minimum of load acting thereon.

The bias power source 23 applies a bias for development only to the bias terminal 24 of the developing section brought to the developing position. When any one of the developing sections is brought to the developing position, the bias terminal 24 and the shaft 284*a* of the developing roller 284 surely contact each other before the developer on the roller 284 contacts the drum 200. Also, when the above developing section leaves the developing position, the bias terminal 24 and shaft 284*a* surely remain in contact with each other until the developer fully leaves the drum 200.

The bias to be applied from the bias power source 23 to the bias terminal 24 is an AC-biased DC voltage. A controller, not shown, selectively sets up or shuts off the output of the AC voltage from the bias power source 23 at a preselected timing independently of the DC voltage, thereby varying the value of the DC voltage at a preselected timing. For example, before a revolver motor 295 (see FIG. 5) is energized, i.e., when the developer on the developing roller 284 is in contact with the drum 200, the controller shuts off the AC component. Subsequently, the revolver motor 295 is energized to rotate the revolver 230 to thereby release the developer from the drum 200. The revolver motor 295 is then deenergized when the developer on the developing roller 284 of the next developing section is brought into contact with the drum 200. Thereafter, the AC component is applied. Such a procedure prevents the AC component from activating the developer and making it easy to move and thereby obviates the deposition of the carrier and toner on the drum 200.

A method of driving the revolver 230 will be described more specifically later.

The replenishment of fresh toner to the individual developing section will be described hereinafter. As shown in FIG. 7, a toner cartridge unit 240 is mounted to the support 21 via the front plate 21*a*. The toner cartridge unit 240 is coaxial with the revolver 230, but closer to the front end of the copier body than the revolver 230. FIG. 4B shows the toner cartridge unit 240 in a section. As shown, toner cartridges 241K, 241C, 241M and 241Y each storing toner of particular color are removably mounted to the toner cartridge unit 240 in one-to-one correspondence to the developing sections. The toner cartridge unit 240 additionally includes toner hoppers 242K, 242C, 242M and 242Y for receiving toner from the toner cartridges 241K, 241C, 241M and 241Y, respectively.

As shown in FIGS. 5 and 6, the revolver 230 is journalled to the front and rear end plates 230*a* and 230*b* via bearings 293*a* and 293*b*, respectively. A driven gear 294 is mounted on the rear end plate 230*b* and held in mesh with a drive gear 296, which is mounted on the output shaft of the revolver motor 295. When the revolver motor 295 drives the revolver 230 via the drive gear 296 and driven gear 294, the developing sections 231K through 231C, toner cartridges 241K through 241Y and toner hoppers 242K through 242Y rotate integrally with each other. At this instant, the toner in each toner cartridge is agitated.

FIG. 8 shows the toner cartridge 241K mounted to the toner hopper 242K by way of example. As shown, the toner cartridge 241K is slid onto the toner hopper 242K until an opening 300*a* formed in the former aligns with an opening 300*b* formed in the latter via a seal member. When the revolver 230 rotates, toner in the toner cartridge 241K flows into the toner hopper 242K due to the rotation and gravity.

Figure 10:
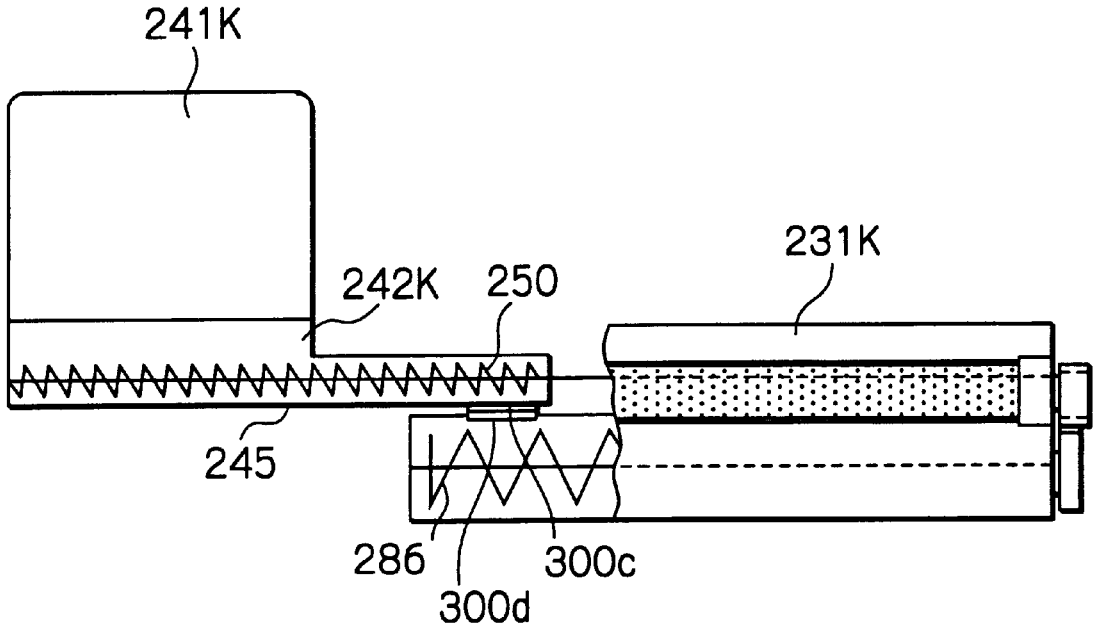
FIG. 10 is a vertical section showing the toner cartridge unit and a toner conveying section.

As shown in FIG. 10, toner pipes 245K, 245C, 245M and 245Y (only 245K is shown) respectively extend from the toner hoppers 242K, 242C, 242M and 242Y to the developing sections 231K, 231C, 231M and 231Y. Screws or toner conveying members 250K, 250C, 250M and 250Y (only 150K is shown) are disposed in the toner pipes 245K, 245C, 245M and 245Y and extend into the toner hoppers 242K, 242C, 242M and 242Y, respectively. The screws 250K through 250Y each are positioned right above the first screw 286 in the associated developing section. In the illustrative embodiment, each of the toner pipes 245K through 245Y and associated one of the screws 250K through 250Y constitute toner conveying means. Further, the toner conveying means, toner cartridge unit 240 and revolver 230 constitute a developing device.

Figure 14:
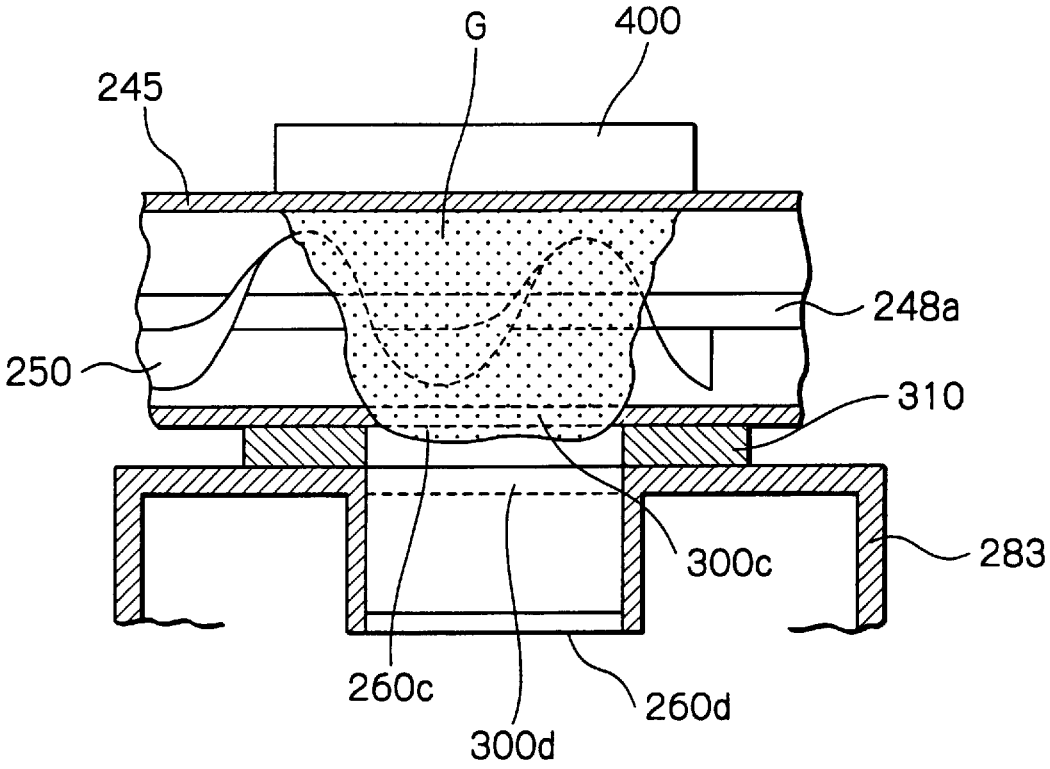
FIG. 14 is a fragmentary enlarged section of the portion S.

As shown in FIG. 7, each screw 250 has a shaft 248*a*. The screw 248*a* and pipe 245 accommodating it protrudes toward the revolver 230 via openings formed in the front end plate 230*a* of the revolver 230 and openings formed in a disk-like unit plate 240*a*. As shown in FIG. 14, the toner pipe 245 is formed with a toner outlet 300*c* while the developing section is formed with a toner inlet 300*d*. The toner outlet 300*c* is fluidly communicated to the toner inlet 300*d* while crushing a seal member 310 fitted on the developing section.

As shown in FIG. 7, a gear 248 is mounted on the end portion of each shaft 248*a* and held in mesh with a drive gear 298*a* shown in FIG. 5. Assume that a motor for toner replenishment, not shown, mounted on the rear plate 21*b* drives the drive gear 298*a* via a plurality of gears including an idler gear 298*b*. Then, the gear 248 corresponding to the developing section located at the developing position is brought into mesh with the drive gear 298*a*, causing the screw 250 located at the developing position to rotate. As a result, the toner conveyed from the toner hopper 242K is replenished into the developing section 231K. In the casing 283, the above toner is agitated together with the magnetic carrier.

Figure 11:
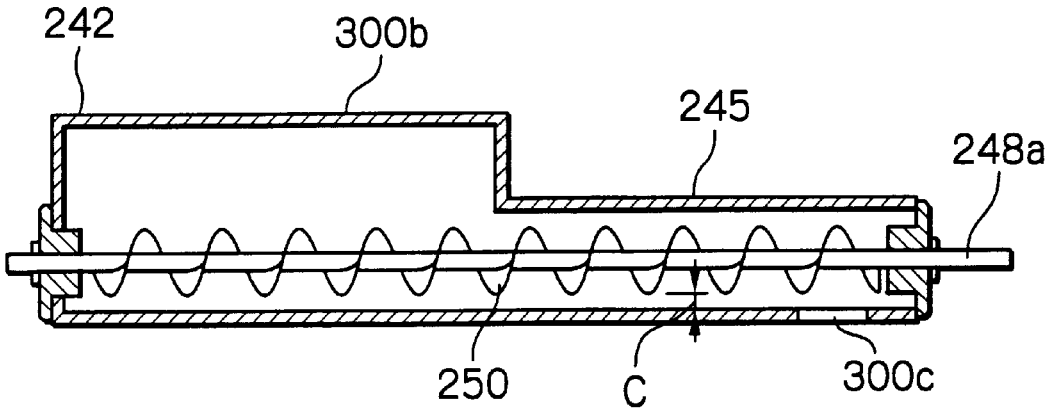
FIG. 11 is a section showing a clearance between a toner passage and toner conveying means included in the revolver.

As shown in FIG. 11, a clearance C is provided between the screw 250 and the toner pipe 245 for the previously stated purpose. The clearance C, however, causes the toner to unexpectedly flow into the developing section, as discussed earlier. The illustrative embodiments solves this problem, as will be described hereinafter with reference to FIGS. 12 and 14. FIG. 14 shows a portion where the toner pipe 245 is communicated to the developing section, as shown in FIGS. 12 and 13, in an enlarged view.

Figure 12:
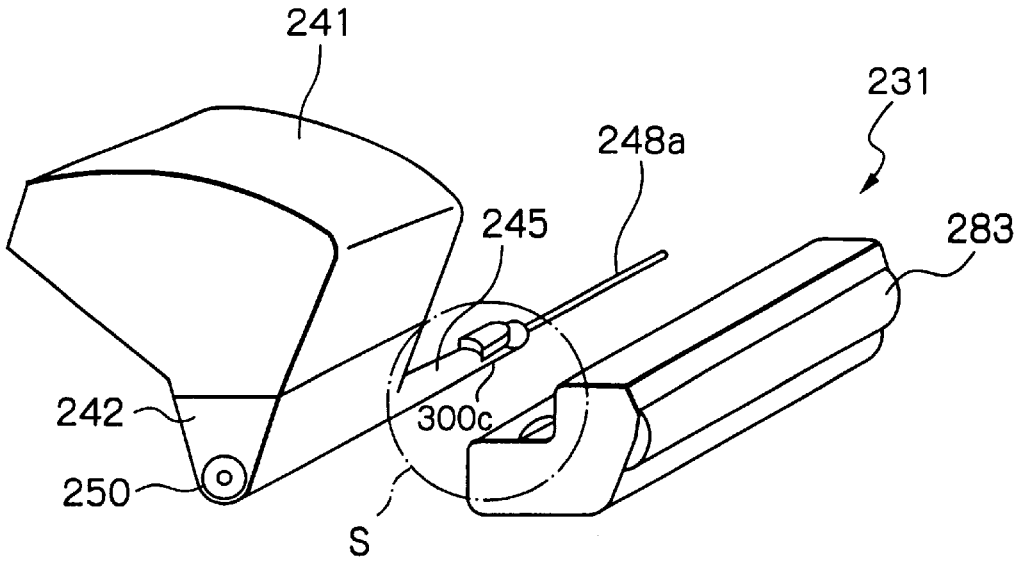
FIG. 12 is an isometric view showing how a toner hopper included in the toner cartridge unit is engaged with the developing section.
Figure 13:
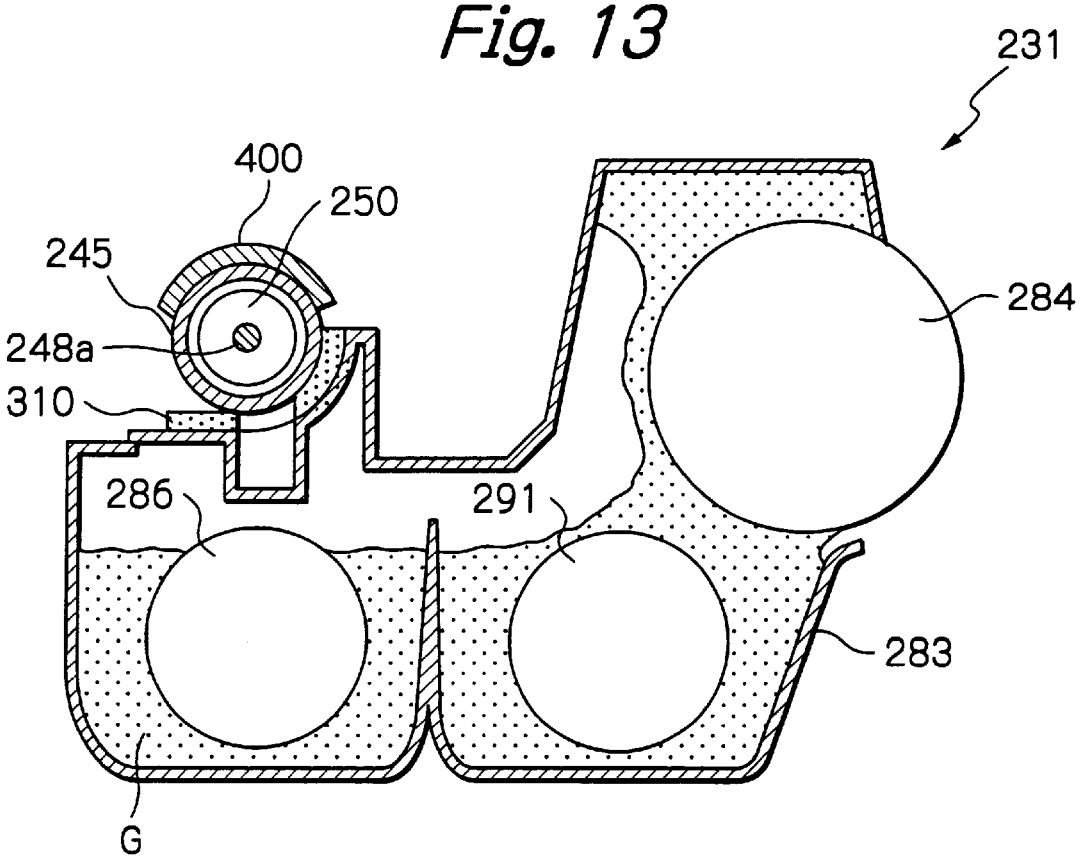
FIG. 13 is a section showing a portion S of FIG. 12 in detail.
Figure 15:
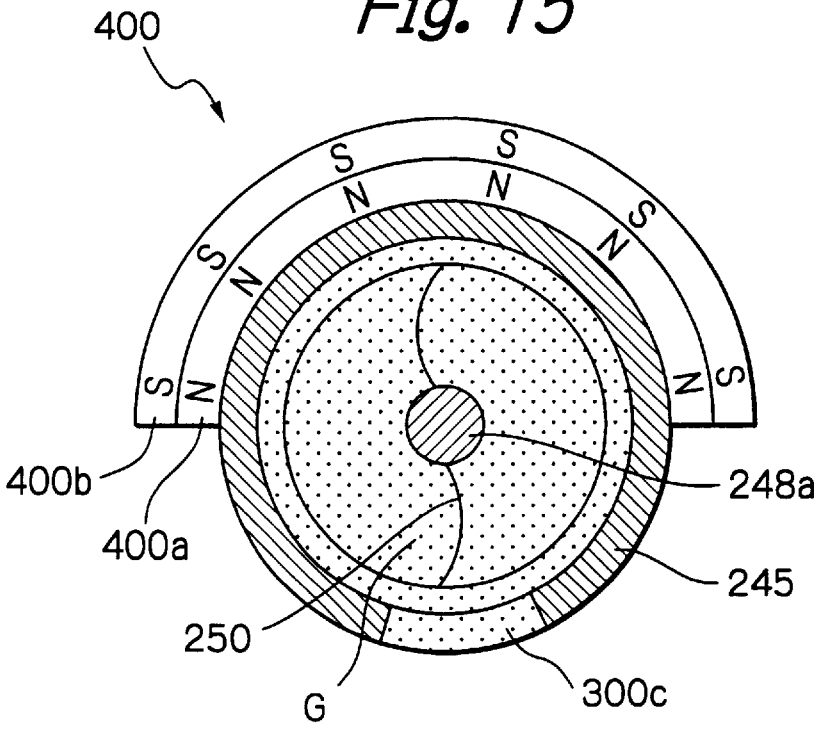
FIG. 15 is a fragmentary section showing magnetic field forming means included in the illustrative embodiment.
Figure 16:
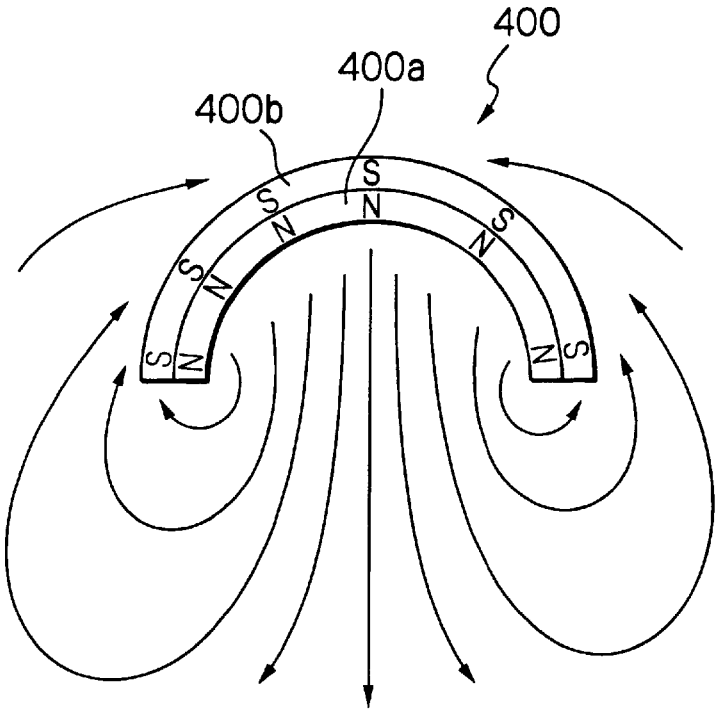
FIG. 16 shows magnetic lines of force extending out from the magnetic field forming means for FIG. 15.

As shown in FIGS. 12 through 14, a magnet or magnetic field forming means 400 is mounted on the toner pipe 245 in the vicinity of the toner outlet 300*c*. As shown in FIG. 15, the magnet 400 surrounds part of the circumference of the toner pipe 245 and has opposite magnetic poles arranged in the radial direction. More specifically, the magnet 400 is made up of an inner magnet (N pole) 400*a* covering part of the circumference of the toner pipe 245 and an outer magnet (S pole) 400*b* surrounding the inner magnet 400*a*. The inner magnet 400*a* faces the toner outlet 300*c* formed in the toner pipe 245. As shown in FIG. 16, a magnetic field formed by the magnet 400 traverses the toner pipe 245 over the entire diameter of the pipe 245. Further, the magnet 400 is symmetrical in the right-and-left direction, as viewed in FIG. 16, with respect to the center of the toner outlet 300*c*.

When the toner pipe 245 and developing section 231 are replaced in position in the up-and-down direction due to the rotation of the revolver 230, the developer G flows into the toner pipe 245. At this instant, the magnetic field formed around the toner outlet 300*c* by the magnet 400 attracts the developer G. Consequently, as shown in FIG. 15, the developer G stops up the toner outlet 300*c*. Even when the revolver 230 further rotates to bring the above developing section 231 to the developing position, the magnetic field retains the developer G in the toner pipe 245 without causing it to drop into the developing section 231 despite gravity.

The force of the magnet 400 is selected such that the toner can move into the developing section 231 via the toner outlet 300*c* when the screw 250 is driven. More specifically, when the screw 250 is rotated in response to a toner replenish signal, it scrapes off the developer G magnetically retained in the toner pipe 245 and lets it drop into the developing section 231 due to gravity. Consequently, the toner pipe 245 is again communicated to the developing section 231, allowing the toner to be replenished into the developing section 231.

Figure 17:
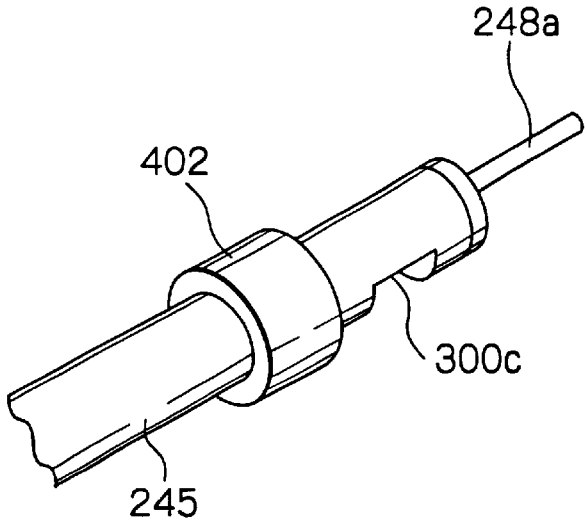
FIG. 17 is an isometric view showing another specific configuration of the magnetic field forming means.
Figure 18:
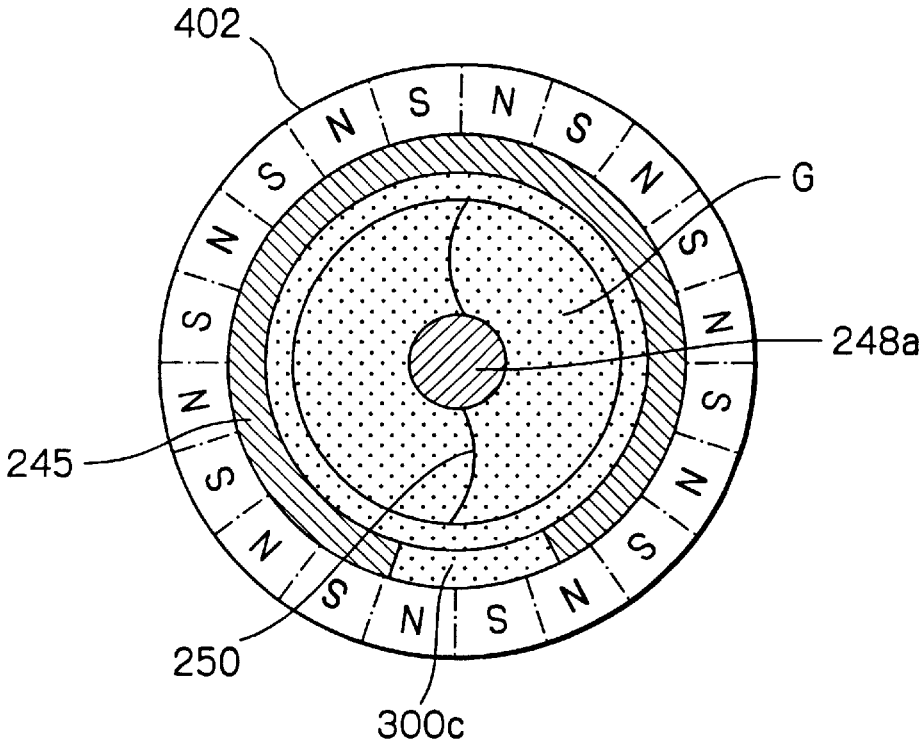
FIG. 18 is a fragmentary section showing the magnetic field forming means of FIG. 17.
Figure 19:
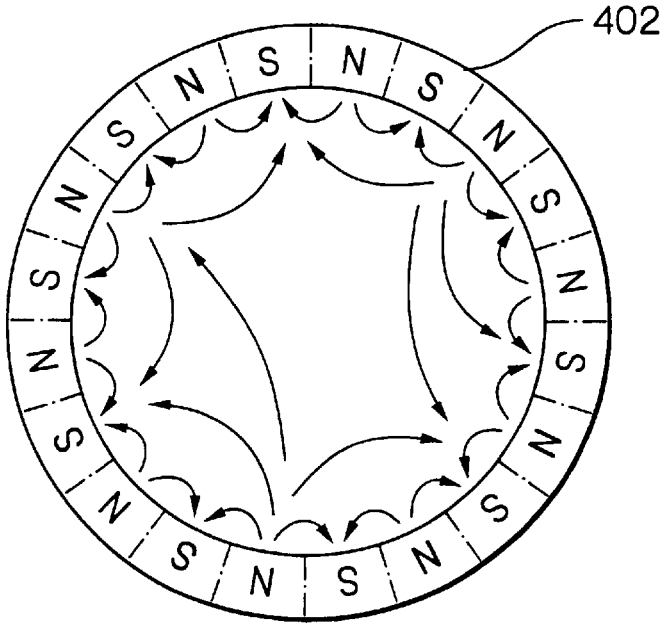
FIG. 19 shows magnetic lines of force extending out from the magnetic field forming means of FIG. 17.

Reference will be made to FIGS. 17 through 19 for describing a modification of the illustrative embodiment. In the modification, structural elements identical with the structural elements of the illustrative embodiment are designated by identical reference numerals and will not be described specifically in order to avoid redundancy.

As shown in FIGS. 17, an annular magnet 402 surrounds the entire circumference of the toner pipe 245 in the vicinity of the toner outlet 300*c*. As shown in FIG. 18, the magnet 402 has opposite polarities alternating with each other in the circumferential direction of the toner pipe 245. As shown in FIG. 19, a magnetic field formed by the annular magnet 402 traverses the toner pipe 245 over the entire diameter of the pipe 245. As shown in FIG. 18, such a magnetic field adjoining the toner outlet 300*c* of the toner pipe 245 attracts the developer G and causes it to stop up the toner outlet 300*c* in the same manner as in the illustrative embodiment. The force of the magnet 402 is also selected such that the toner can move into the developing section 231 via the toner outlet 300*c* when the screw 250 is driven. Therefore, when the screw 250 is rotated in response to a toner replenish signal, it scrapes off the developer G magnetically retained in the toner pipe 245 and lets it drop into the developing section 231 due to gravity. Consequently, the toner pipe 245 is again communicated to the developing section 231, allowing the toner to be replenished into the developing section 231.

If desired, the annular magnet 402 may cover the toner outlet 300*c* if it is formed with a notch aligning with the toner outlet 300*c*.

As stated above, the illustrative embodiment and modification thereof achieve various unprecedented advantages, as enumerated below.

(1) A magnetic field traverses a toner passage over the entire diameter of the toner passage, so that a developer can surely seal a toner outlet formed in the wall of the toner passage. This accurately controls the unexpected flow of toner into a developing section ascribable to the rotation of a developing device without regard to a clearance between the wall of the toner passage and toner conveying means. It is therefore possible to obviate uncontrollable increase of toner content, which would bring about toner scattering and defective images.

(2) Magnetic field forming means surrounds part of the circumference of the toner passage and has opposite polarities arranged in the radial direction of the toner passage. The magnetic field forming means therefore implements an intense magnetic force while occupying a minimum of space.

(3) The magnetic field forming means is substantially symmetrical with respect to the toner outlet, insuring a sealing function available with the developer.

(4) The magnetic field forming means surrounds the entire circumference of the toner passage and has opposite polarities alternating in the circumferential direction of the toner passage. This successfully reduces the production cost of the magnetic field forming means while allowing the developer to surely seal the toner outlet.

(5) The magnetic field forming means covers the toner outlet and is formed with a notch aligning with the toner outlet. This is also successful to achieve the above advantage (4).

(6) The magnetic force of the magnetic field forming means is selected such that the toner can move into the developing section via the toner outlet when a toner conveying member is driven. This well balances the sealing function available with the developer and the function of replenishing the toner into the developing section.

An alternative embodiment of the present invention will be described hereinafter. The rotation speed of the revolver 230 presumably has noticeable influence on the amount of unexpected outflow of toner into the developing section 231. A series of researches and experiments on the relation between the above rotation speed and the amount of outflow showed that the revolver 23 made the amount of toner critical in the image quality aspect when rotated at certain speeds. This will be described more specifically with reference to FIG. 20.

Figure 20:
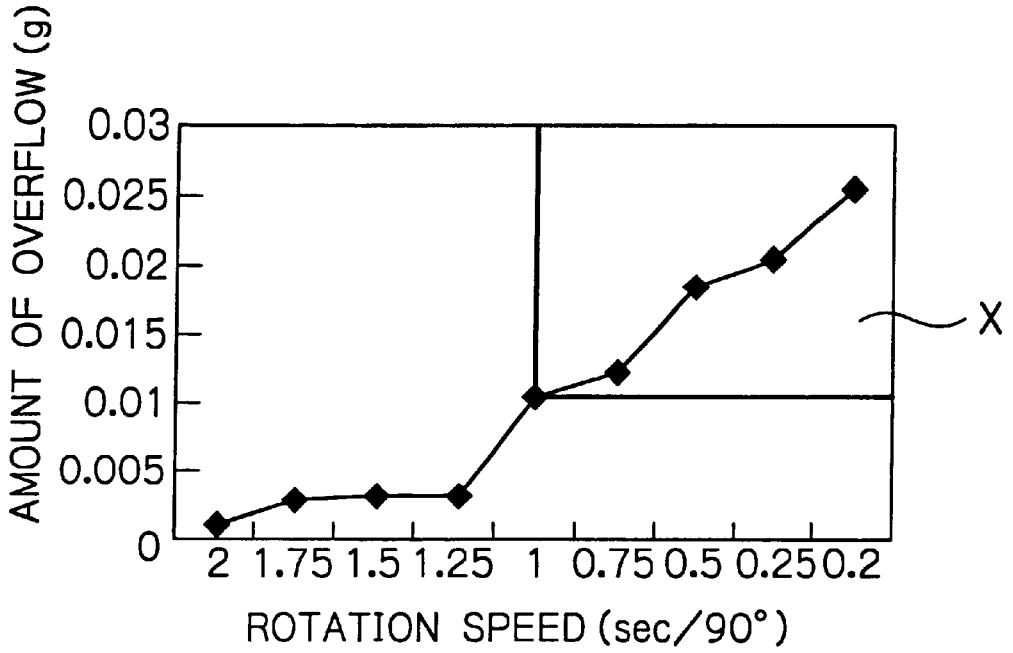
FIG. 20 is a graph showing a relation between the rotation speed of the revolver and the amount of unexpected outflow of toner and pertaining to an alternative embodiment of the present invention.

FIG. 20 shows a relation between the rotation speed of the revolver 230 and the amount of toner unexpectedly flown into the developing section 231. In FIG. 20, the abscissa indicates a period of time necessary for the revolver 230 to rotate by 90° in order to locate one of the developing sections at the developing position. In the full-color copy mode, the revolver 230 repeatedly rotates by 90° with the result that the toner is apt to flow into and accumulate in the developing section 231. In FIG. 20, the ordinate indicates the amount of toner flown into the developing section 231 for a single rotation of the revolver 230. Because the amount of toner for a single rotation of the revolver 230 was extremely small, it was calculated from the amount of toner flown for 500 rotations. The amount of toner was undesirable in a range X shown in FIG. 20.

As FIG. 20 indicates, when the period of time necessary for the revolver 230 to rotate by 90° is shorter than 1 second, much toner flows into the developing section 231. The revolver 230 rotated at such a speed must be provided with a measure against the unexpected outflow of toner. When the above period of time is longer than 1 second, the amount of toner to flow into the developing section 231 is as small as about 0.003 g and is sufficiently consumed by an average image customary in a market. Even if such an amount of toner is not consumed by an average image at all, it is successfully consumed by process control or similar automatic machine adjustment.

It is necessary with the color copier shown in FIG. 3 to vary the rotation speed of the revolver 230 in accordance with a copying speed. In a high-speed color copier, for example, the rotation speed of the revolver 230 must be increased. The alternative embodiment is capable of obviating the unexpected outflow of the toner even when the rotation speed of the revolver 230 is less than 1 second for the rotation angle of 90°, as will be described with reference to FIGS. 21 through 23. This embodiment can therefore adapt even to a high-speed machine.

Figure 21:
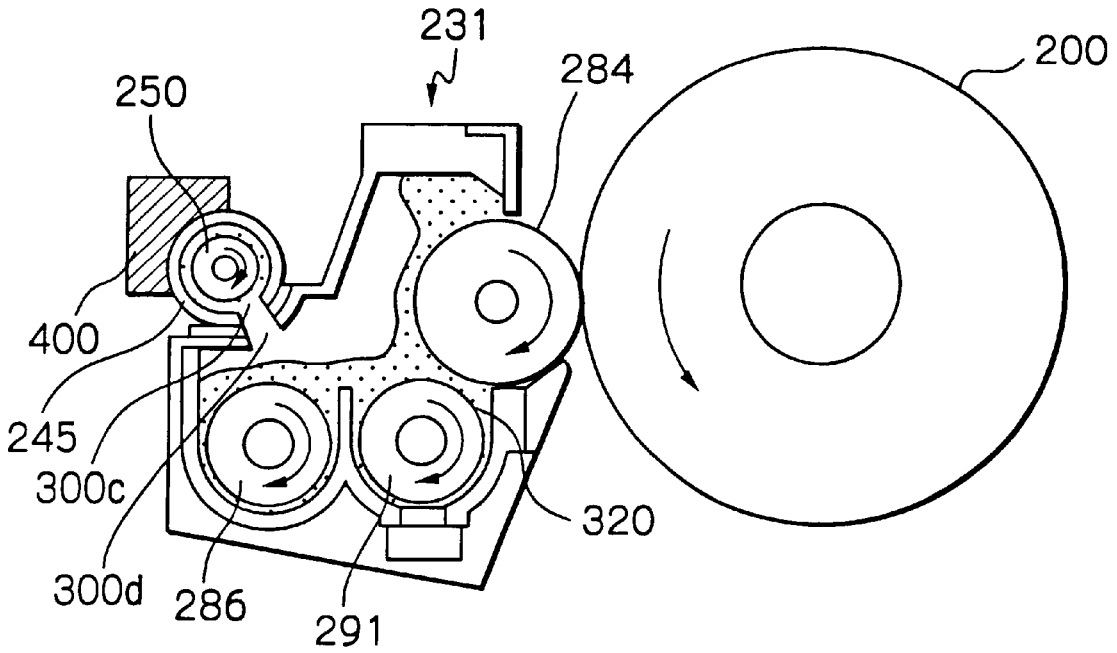
FIG. 21 is a section showing a portion where the developing section and a toner pipe are connected together at a developing position in the alternative embodiment.
Figure 22:
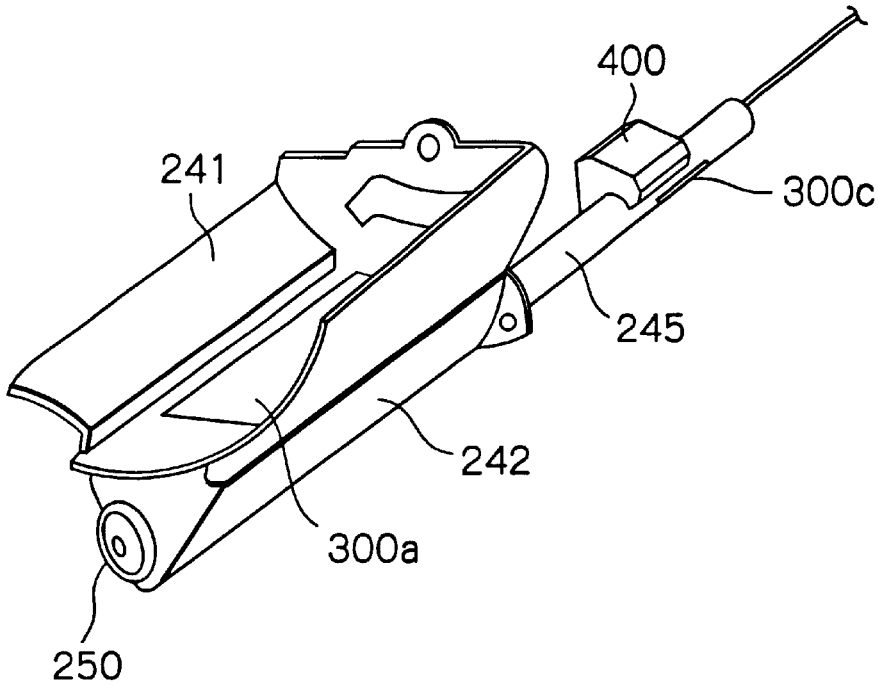
FIG. 22 is an isometric view showing the toner pipe and a toner cartridge.

FIG. 21 shows the portion where the toner pipe 245 and developing section 231 are communicated to each other. FIG. 22 shows the toner pipe 245 and toner cartridge 241. As shown, the magnet or magnetic field forming means 400 is mounted on the toner pipe 245 in the vicinity of the toner outlet 300*c*. The toner pipe 245 and screw 250 disposed therein each are formed of a nonmagnetic material.

Figure 23:
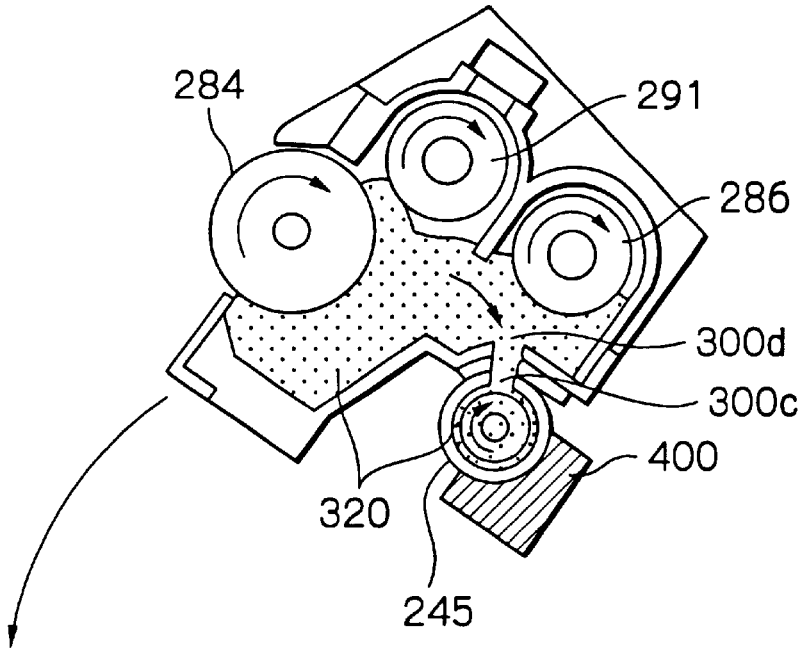
FIG. 23 is a view showing a magnetic developer flows out of the developing section into the toner pipe due to the rotation of the revolver.

Assume that the toner pipe 245 and developing section 231 are replaced with each other in the up-and-down direction due to the rotation of the revolver 230. Then, as shown in FIG. 23, a developer 320 present in the developing section 231 flows into the toner pipe 245. At this instant, the magnetic field formed in the vicinity of the toner outlet 300*c* by the magnet 400 attracts the developer 320 and retains it. Even when the revolver 230 further rotates to locate the developing section 231 at the developing position, the magnetic field retains the developer 320 in the toner pipe 245 without causing it to drop into the developing section 231. The developer 320 stopping up the toner outlet 300*c* prevents the toner from unexpectedly flowing into the developing section 231 despite the rotation of the revolver 230.

When the screw 250 is rotated in response to a toner replenish signal, the screw 250 scrapes off the developer 320 retained in the toner pipe 245 and lets it drop into the developing section 231 due to gravity. As a result, the toner pipe 245 is again communicated to the developing section 231 via the toner outlet 300*c*, allowing the toner to be again replenished into the developing section 231.

Further, because the toner pipe 245 and screw 250 each are formed of a nonmagnetic material, the screw 250 can scrape off the developer 320 retained in the toner pipe 245 with a minimum of resistance acting thereon. The developer 320 therefore immediately yields to the conveying force of the screw 250, implementing rapid, sure toner replenishment. Assume that the toner pipe 245 and screw 250 each are formed of a magnetic material. Then, the force of the magnetic field retaining the developer 230 is intensified and increases a period of time necessary for the developer 230 to yield to the conveying force of the screw 250, effecting the toner replenishing ability.

As stated above, the magnet 400 adjoining the toner outlet 300*c* of the toner pipe 245 causes the developer 320 to interrupt fluid communication between the toner pipe 245 and the developing section 231 without fail except when the toner should be replenished. It follows that the toner is prevented from needlessly flowing into the developing section 231 despite the clearance between the toner pipe 245 and the screw 250. In the event of toner replenishment, the screw 250 is driven to again set up fluid communication between the toner pipe 245 and the developing section 231.

Moreover, the magnet 400 prevents the developer 320 from reversely flowing into the toner pipe 245 and toner cartridge 241.

The illustrative embodiment therefore obviates the unexpected flow of the toner into the developing section 231 ascribable to the rotation of the revolver 230 even when the period of time necessary for the revolver 230 to rotate by 90° is shorter than 1 second. It follows that even in a high-speed color copier the toner content of the developer in the developing section 231 is prevented from increasing to a degree that would render an image excessively dense or would contaminate the background of an image.

Hereinafter will be described a relation between the cohesiveness of the toner stored in the toner cartridge 241 and the unexpected outflow of the toner. A current trend in the color copiers art is toward the use of toner with low cohesiveness for enhancing image quality. This kind of toner can be rapidly mixed with a developer and rapidly stabilizes the characteristics of the developer. A series of experiments showed that the cohesiveness of toner applied to the revolver 230 had critical influence on the unexpected outflow of the toner.

To measure the cohesiveness of toner, the experiments used a powder tester Type PT-E (trade name) available from HOSOKAWA MICRON CORP. Specifically, a Bibroshoot, a packing, a spacer ring, three kinds of sieves (top, center and bottom) and a press bar were sequentially set on a vibration stage. After such an assembly was affixed by a knob nut, the vibration stage was caused to vibrate. Measurement was effected under the following conditions:

| | |
|---|---|
| top sieve size | 150 μm |
| center sieve size | 75 μm |
| bottom sieve size | 45 μm |
| scale | 1 mm |
| amount of sample | 2 g |
| vibration time | 30 seconds |

To determine cohesiveness, there were produced:

wt % of powder left on top sieve×1 (a)

wt % of powder left on center sieve×0.6 (b)

wt % of powder left on bottom sieve×0.2 (c)

The above values (a), (b) and (c) were then added to determine cohesiveness (%).

Figure 24:
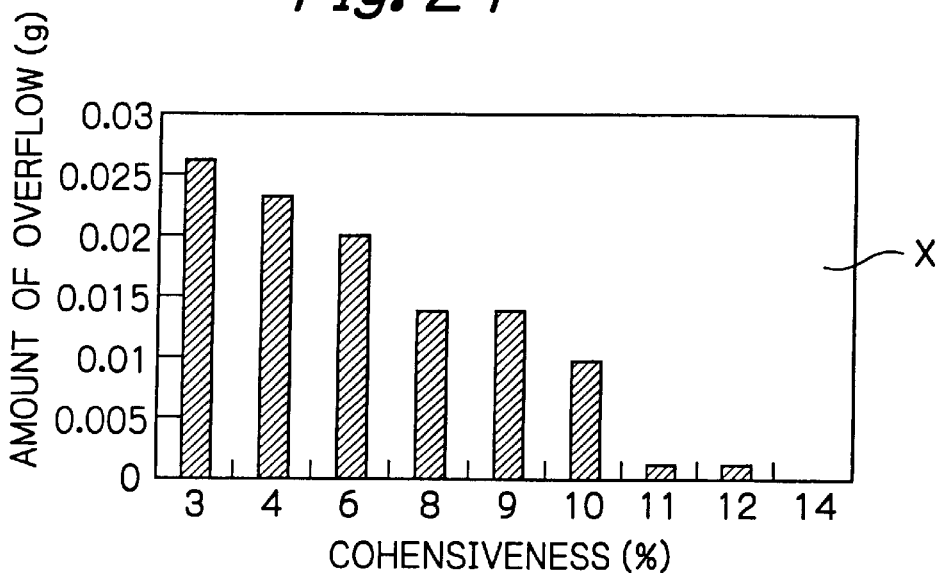
FIG. 24 is a graph showing a relation between the cohesiveness of toner and the amount of unexpected outflow of toner.

FIG. 24 shows a relation between the cohesiveness of the toner stored in the toner cartridge 241 and the amount of the toner unexpectedly flown into the developing section 231. In FIG. 24, the ordinate indicates the amount of the toner flown into the developing section 231 for a single rotation of the revolver 230. The abscissa indicates cohesiveness. Again, the amount of the toner was derived from the total amount of the toner flown out for 500 rotations of the revolver 230 for the previously stated reason.

As FIG. 24 indicates, when cohesiveness is lower than 10%, the toner flows into the developing section 231 in a noticeable amount. Therefore, when toner with such a degree of cohesion is used, an arrangement for blocking the toner is essential. On the other hand, when cohesiveness is higher than 10%, the amount of toner to flow into the developing section 231 is extremely small. This is presumably because the high cohesiveness allows the toner to resist vibration and air pressure ascribable to rotation. The small amount of toner can be sufficiently consumed by an average image commercially accepted. Even if the toner is not consumed by an average image at all, it can be consumed by process control or similar automatic machine adjustment.

In light of the above, in the illustrative embodiment, the toner stored in the toner cartridge 241 has cohesiveness of below 10%. In addition, as shown in FIGS. 21 through 23, the magnet or magnetic field forming means 400 is mounted on the toner pipe 245 in the vicinity of the toner outlet 300*c*. In this condition, despite that the degree of cohesion of the toner is below 10%, the toner is prevented from flowing into the developing section 231 during the rotation of the revolver 230 and does not effect image quality.

Figure 25A:
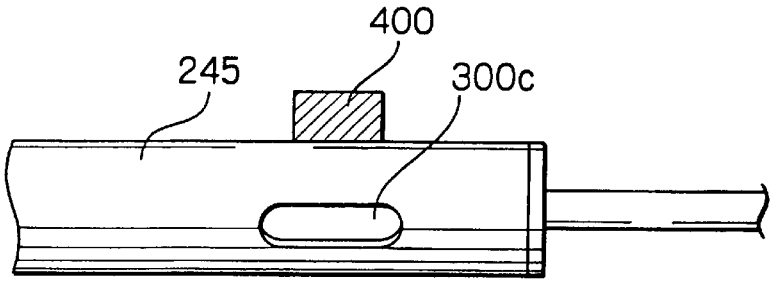
FIG. 25A is a view showing a specific position of a magnet.
Figure 25B:
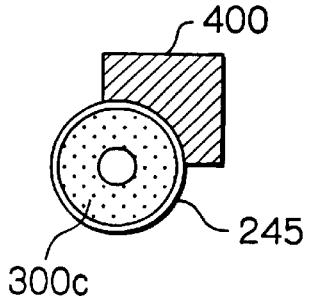
FIG. 25B is a section showing the condition of the magnetic developer derived from the position of FIG. 25A.

Specific positions where the magnet 400 may be mounted will be described hereinafter. FIG. 25A shows the magnet 400 positioned right above the toner outlet 300*c* of the toner pipe 245. In this case, as shown in FIG. 25B, the magnet 400 forms a magnetic field around the toner outlet 300*c* and magnetically retains the developer 320. However, the developer 320 extends out from the toner outlet 300*c* in the form of an icicle and fails to exhibit the expected sealing ability. This is aggravated when the icicle-like developer 320 drops due to vibration, so that the toner is apt to flow out via the toner outlet 300*c*.

Figure 26A:
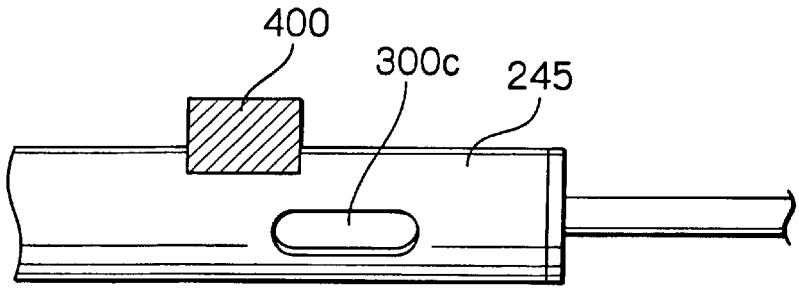
FIG. 26A is a view showing another specific position of the magnet.
Figure 26B:
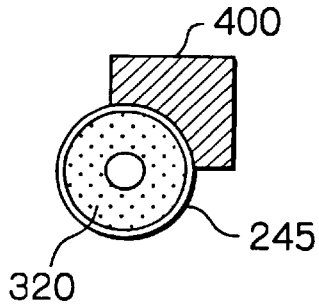
FIG. 26B is a section showing the condition of the magnetic developer derived from the position of FIG. 26A.

To solve the above-described problem, as shown in FIG. 26A, the illustrative embodiment locates the magnet 400 such that it extends from the toner outlet 300*c* to a position upstream of the toner outlet 300*c*. In this case, the magnet 400 forms a magnetic field extending from the portion of the toner pipe 245 where the toner outlet 300*c* is formed to the portion of the same upstream of the toner outlet 300*c*. As shown in FIG. 26B, in the portion upstream of the toner outlet 300*c*, the developer 320 does not extend out of the toner pipe 245. The magnetic field therefore evenly, intensely attracts the developer 320 present in the toner pipe 245, thereby preventing the toner from flowing into the developing section 231 more positively.

Figure 27:
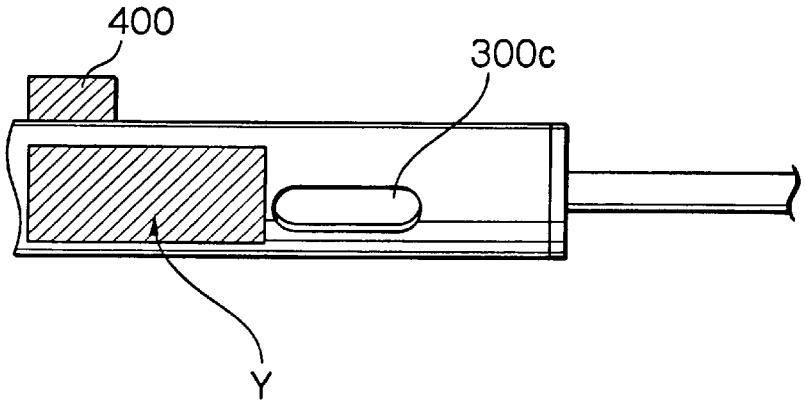
FIG. 27 is a view showing still another specific position of the magnet.

As shown in FIG. 27, assume that the magnet 400 is located at a position more upstream than the position shown in FIG. 26A. Then, although the magnet 400 attracts the developer 320 in the toner pipe 245 as evenly as in the configuration of FIG. 26A, it broadens an area Y over which the developer 320 enters the toner pipe 245. As a result, the period of time necessary for the screw 250 to scrape off the magnetically retained developer 320 and convey it at the time of toner replenishment increases, resulting in slow response in toner replenishment.

For the reasons described above, the magnet 400 should preferably extend from the toner outlet 300*c* to the position upstream of the toner outlet 300*c*, as shown in FIG. 26A. More specifically, the magnet 400 should preferably extend from the toner outlet 300 to a position upstream of the toner outlet 300 by one to two pitches in terms of the pitch of the screw 250, i.e., about 15 mm in terms of distance. Experiments showed that the magnet 400 located at the above position surely prevented the toner from unexpectedly flowing into the developing section 231 without slowing down the response.

As stated above, the magnet 400 forms a magnetic field for retaining the magnetic developer 320 flown from the developing section 231 into the toner pipe 245 during the rotation of the revolver 230. This successfully prevents the toner from unexpectedly flowing into the developing section 231. To allow the developer 320 to flow into the toner pipe 245, the toner inlet 300*d* of the developing section 231 is kept open.

Figure 28A:
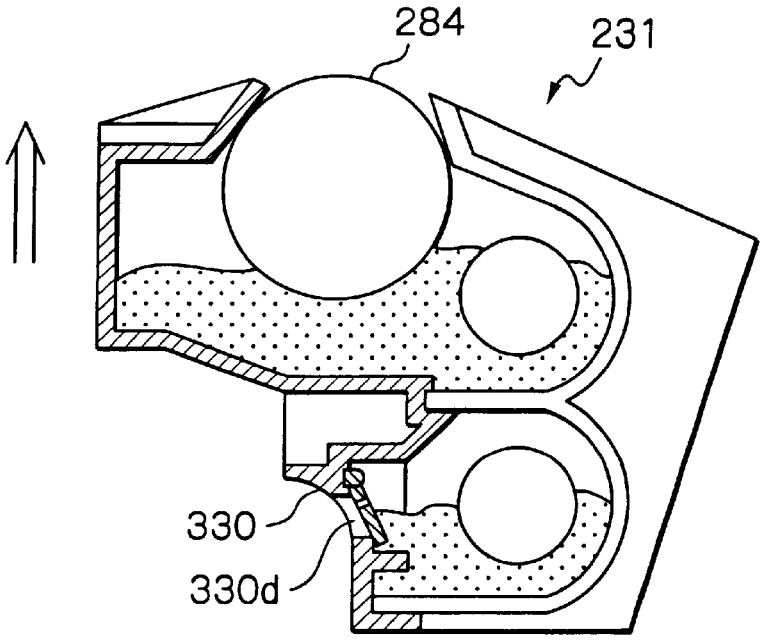
FIG. 28A is a section showing a shutter included in the developing section.
Figure 28B:
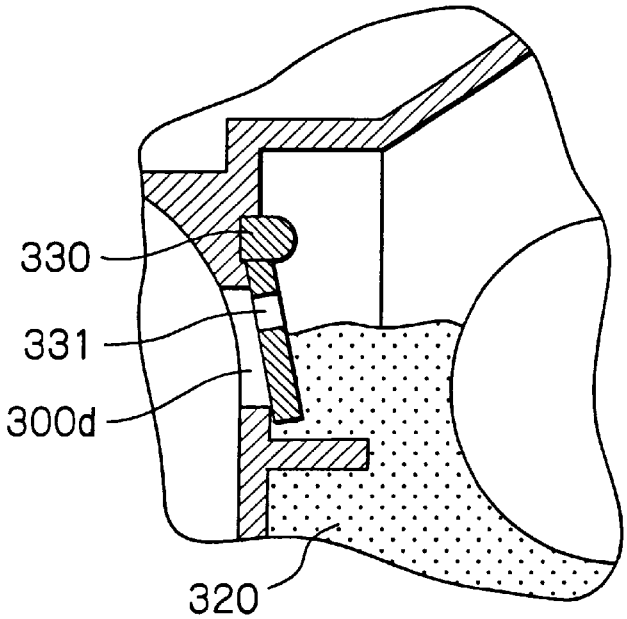
FIG. 28B is an enlarged section showing part of FIG. 28A.
Figure 29:
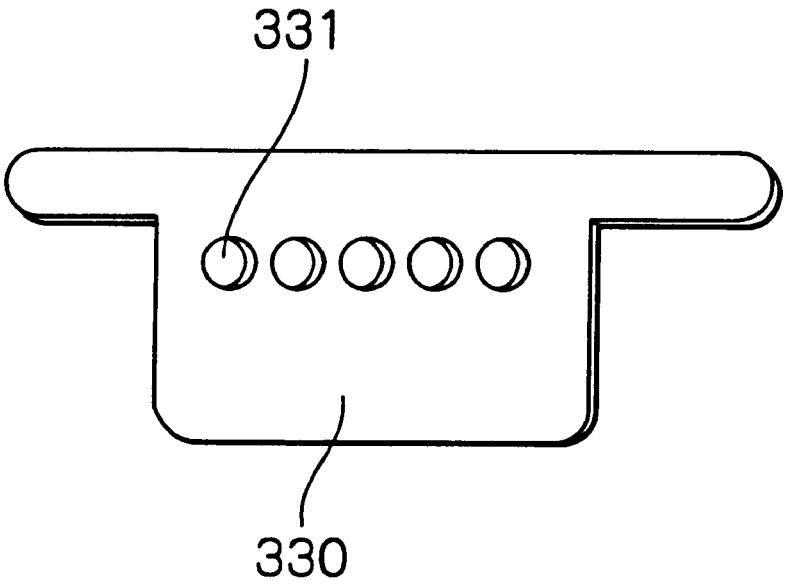
FIG. 29 is a view showing a specific configuration of the shutter.

In the event of maintenance, the developing section 231 of the revolver 230 is moved to a dismounting position and then dismounted. At this instant, much developer 320 present in the developing section 231 flows out via the toner inlet 300*d* of the developing section 231. In light of this, as shown in FIGS. 28A, 28B and 29, the illustrative embodiment additionally includes a shutter 330 for closing the toner inlet 300*d*. The shutter 330 is formed with holes 331 in its portion that will be an upper portion when the developing section 231 is brought to the dismounting position.

The shutter 330 is so controlled as to open only when the toner should be replenished. When the shutter 330 is opened, the toner is replenished from the toner pipe 245 into the developing section 231 via the toner inlet 300*d*. The shutter 330 remains closed when the toner is not replenished. However, when the toner pipe 245 and developing section 231 are replaced with each other in the up-and-down direction due to the rotation of the revolver 230, the shutter 330 is positioned below the developing section 231. As a result, the developer 320 flows from the developing section 231 into the toner pipe 245 via the holes 331 of the shutter 330. Further, when the developing section 231 is moved to the dismounting position for maintenance, the shutter 330 remains closed with its holes 331 positioned in its upper portion. In this condition, the lower portion of the shutter 330 prevents the developer 320 from flowing out via the toner inlet 300*d*. Moreover, the holes 331 positioned in the upper portion of the shutter 330 reduces the amount of the developer 320 to flow out via the holes 331, compared to the case wherein the toner inlet 300*d* is kept open. This prevents much developer 320 from flowing out of the developing section 231 at the dismounting position. In FIG. 28A, an arrow A indicates a direction in which the developing section 231 is dismounted.

To omit the shutter 330, the toner inlet 300*d* itself may be reduced in size and so positioned as to cause a minimum of developer to flow out of the developing section 231 when the developing section 231 is moved to the dismounting position. This, however, is apt to cause the toner replenished via such a small toner inlet 300*d* to stop up the toner inlet 300*d* or apt to make toner replenishment short.

Figure 30:
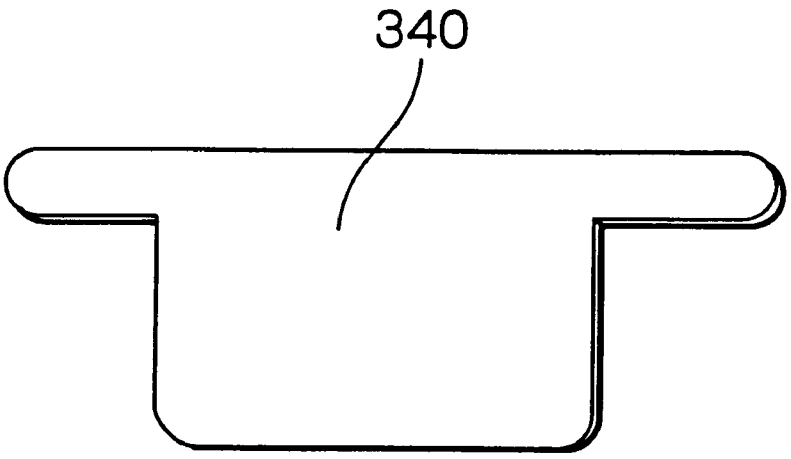
FIG. 30 is a view showing another specific configuration of the shutter.

The shutter 330 obstructs the developer 320 tending to flow out of the developing section 231 when the developing section 231 is dismounted, as stated above. However, after the developing section 231 has been dismounted, the developer 320 flows out and contaminate surroundings, depending on the position of the developing section 231 held by hand. FIG. 30 shows a shutter 340 configured to solve this problem.

Figure 31A:
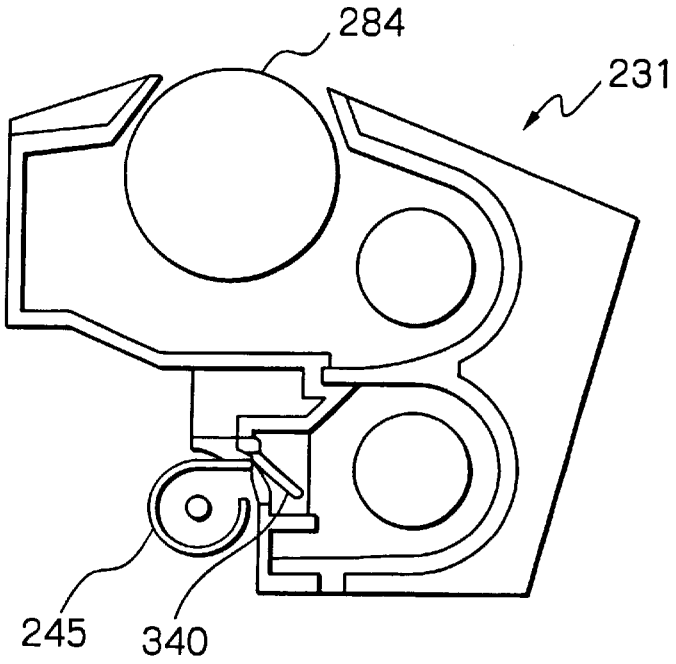
FIG. 31A is a section showing how the shutter of FIG. 30 opens and closes in interlocking relation to the mounting/dismounting of the developing section.
Figure 31B:
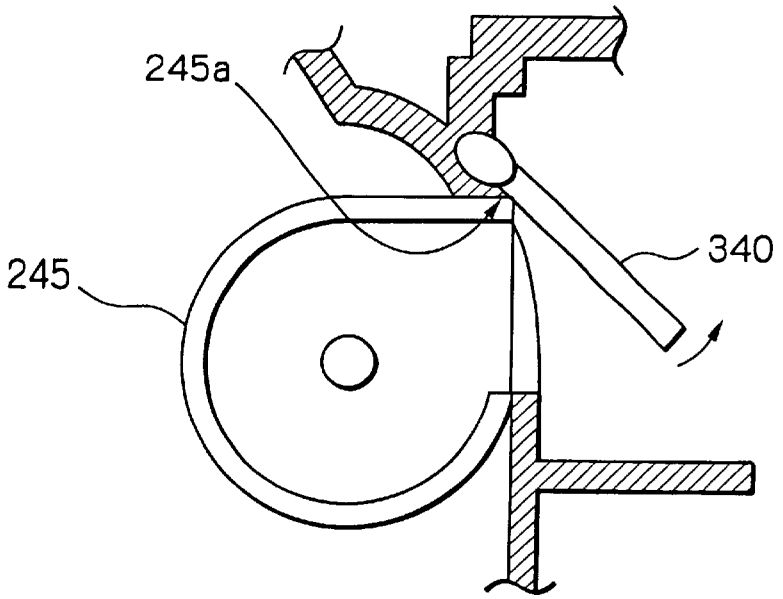
FIG. 31B is an enlarged section showing part of FIG. 31A.

As shown in FIG. 30, the shutter 340 is not formed with any hole and caused to selectively open or close in interlocked relation to the mounting/dismounting of the developing section 231. Specifically, as shown in FIGS. 31A and 31B, when the developing section 231 is mounted to the revolver 230, part 245*a* of the toner pipe 245 interferes with the shutter 340 and causes it to open. While the shutter 340 is open, the toner can be replenished from the toner pipe 245 into the developing section 231 via the toner inlet 300*d*, which is unblocked by the shutter 340. When the toner pipe 245 and developing section 231 are replaced with each other in the up-and-down direction due to the rotation of the revolver 230, the developer 320 flows out of the developing section 231 into the toner pipe 245 via the toner inlet 300*d*, which is unblocked by the shutter 340. When the developing section 231 is dismounted from the revolver 230, the shutter 340 is constantly closed and prevents the developer 320 from flowing out of the developing section 231.

As stated above, the illustrative embodiment prevents the toner from flowing out of a toner cartridge into the developing section 231 except when the toner should be replenished into the developing section 231, thereby insuring attractive images. This advantage is achievable even with a high-speed machine or with toner having a low degree of cohesion, which may be used for enhancing image quality. Further, the toner can be surely replenished into the developing section 231. Moreover, when the developing section 231 is dismounted from the revolver 230, the toner is prevented from flowing out of the developing section in a great amount and contaminating surroundings.

While the illustrative embodiments have concentrated on a two-ingredient type developer consisting of toner and magnetic carrier, the present invention is similarly practicable with a one-ingredient type developer, i.e., toner.

Various modifications will become possible for those skilled in the art after receiving the teachings of the present disclosure without departing from the scope thereof.

What is claimed is:

1. An image forming apparatus comprising:

an image carrier;

a rotary developing device adjoining said image carrier and including a plurality of developing sections for developing a latent image formed on said image carrier with a magnetic developer;

a toner cartridge unit including a plurality of toner cartridges and rotatable integrally with said developing device;

a mechanism configured to rotate said rotary developing device and said toner cartridge unit;

a plurality of toner conveying means each connecting one of said plurality of toner cartridges to an associated one of said plurality of developing sections, wherein said plurality of toner conveying means each include a toner passage and a toner conveying member disposed in said toner passage; and magnetic field forming means adjoining a toner outlet, which is formed in said toner passage and communicated to said developing section, for forming a magnetic field that completely traverses said toner passage through a central region of said toner passage.

2. The apparatus as claimed in claim 1, wherein said magnetic field forming means surrounds part of a circumference of said toner passage and has opposite polarities arranged in a radial direction of said toner passage.

3. The apparatus as claimed in claim 2, wherein said magnetic field forming means exerts a magnetic force that allows toner being driven by said toner conveying means to move into said developing section via said toner outlet.

4. The apparatus as claimed in claim 2, wherein said magnetic field forming means faces said toner outlet and is substantially symmetric with respect to said toner outlet.

5. The apparatus as claimed in claim 4, wherein said magnetic field forming means exerts a magnetic force that allows toner being driven by said toner conveying means to move into said developing section via said toner outlet.

6. The apparatus as claimed in claim 1, wherein said magnetic field forming means surrounds an entire circumference of said toner passage and has opposite polarities alternating with each other in a circumferential direction of said toner passage.

7. The apparatus as claimed in claim 6, wherein said magnetic field forming means exerts a magnetic force that allows toner being driven by said toner conveying means to move into said developing section via said toner outlet.

8. The apparatus as claimed in claim 6, wherein said magnetic field forming means covers said toner outlet and has a portion thereof corresponding to said toner outlet notched.

9. The apparatus as claimed in claim 8, wherein said magnetic field forming means exerts a magnetic force that allows toner being driven by said toner conveying means to move into said developing section via said toner outlet.

10. The apparatus as claimed in claim 1, wherein said magnetic field forming means exerts a magnetic force that allows toner being driven by said toner conveying means to move into said developing section via said toner outlet.

11. An image forming apparatus comprising:

a rotary developing device adjoining an image carrier and including a plurality of developing sections for developing a latent image formed on said image carrier with a magnetic developer;

a toner cartridge unit including a plurality of toner cartridges and rotatable integrally with said developing device;

a mechanism configured to rotate said rotary developing device and said toner cartridge unit at rotating speeds of 1 second for 90° of rotation and above;

a plurality of toner conveying means each connecting one of said plurality of toner cartridges to an associated one of said plurality of developing sections, wherein said plurality of toner conveying means each include a toner passage and a toner conveying member disposed in said toner passage; and magnetic field forming means adjoining a toner outlet, which is formed in said toner passage and communicated to said developing section, for forming a magnetic field that completely traverses said toner passage through a central region of said toner passage.

12. An image forming apparatus comprising:

a rotary developing device adjoining an image carrier and including a plurality of developing sections for developing a latent image formed on said image carrier with a magnetic developer;

a toner cartridge unit including a plurality of toner cartridges and rotatable integrally with said developing device;

a mechanism configured to rotate said rotary developing device and said toner cartridge unit;

a plurality of toner conveying means each connecting one of said plurality of toner cartridges to an associated one of said plurality of developing sections, wherein said plurality of toner conveying means each include a toner passage and a toner conveying member disposed in said toner passage; and magnetic field forming means adjoining a toner outlet, which is formed in said toner passage and communicated to said developing section, for forming a magnetic field that completely traverses said toner passage through a central region of said toner passage;

wherein toner stored in each of said plurality of toner cartridges has cohesiveness of 10% or below.

13. An image forming apparatus comprising:

a rotary developing device adjoining an image carrier and including a plurality of developing sections for developing a latent image formed on said image carrier with a magnetic developer;

a toner cartridge unit including a plurality of toner cartridges and rotatable integrally with said developing device;

a mechanism configured to rotate said rotary developing device and said toner cartridge unit;

a plurality of toner conveying means each connecting one of said plurality of toner cartridges to an associated one of said plurality of developing sections, wherein said plurality of toner conveying means each include a toner passage and a toner conveying member disposed in said toner passage; and magnetic field forming means adjoining a toner outlet, which is formed in said toner passage and communicated to said developing section, for forming a magnetic field that completely traverses said toner passage through a central region of said toner passage;

wherein said toner passage and said toner conveying member each are formed—of a nonmagnetic material, and said toner conveying member conveys, when driven, the magnetic developer being magnetically retained in said toner passage by said magnetic field forming means.

14. An image forming apparatus comprising:

a rotary developing device adjoining an image carrier and including a plurality of developing sections for developing a latent image formed on said image carrier with a magnetic developer;

a toner cartridge unit including a plurality of toner cartridges and rotatable integrally with said developing device;

a mechanism configured to rotate said rotary developing device and said toner cartridge unit;

a plurality of toner conveying means each connecting one of said plurality of toner cartridges to an associated one of said plurality of developing sections, wherein said plurality of toner conveying means each include a toner passage and a toner conveying member disposed in said toner passage, said toner conveying member being formed as a screw having a predetermined pitch between screw turns; and magnetic field forming means extending from a toner outlet, which is formed in said toner passage and communicated to said developing section, to a position upstream of said toner outlet in a direction of toner conveyance by a distance corresponding to a distance of one predetermined pitch or a distance of two predetermined pitches for forming a magnetic field.

15. An image forming apparatus comprising:

a rotary developing device adjoining an image carrier and including a plurality of developing sections for developing a latent image formed on said image carrier with a magnetic developer;

a toner cartridge unit including a plurality of toner cartridges and rotatable integrally with said developing device;

a mechanism configured to rotate said rotary developing device and said toner cartridge unit;

a plurality of toner conveying means each connecting one of said plurality of toner cartridges to an associated one of said plurality of developing sections, wherein said plurality of toner conveying means each include a toner passage and a toner conveying member disposed in said toner passage;

magnetic field forming means adjoining a toner outlet, which is formed in said toner passage and communicated to said developing section, for forming a magnetic field; and a shutter having holes at only one portion thereof attached to a toner inlet, which is formed in said developing section and communicated to said toner outlet, for communicating said developing device to said toner passage while said developing section is in rotation or restricting a flow of the magnetic developer out of said developing section when said developing section is dismounted from said developing device.

16. The apparatus as claimed in claim 15, wherein said shutter is selectively opened or closed in interlocked relation to mounting/dismounting of said developing section.

* * * * *

UNITED STATES PATENT AND TRADEMARK OFFICE

CERTIFICATE OF CORRECTION

PATENT NO. : 6,597,881 B2
DATED : July 22, 2003
INVENTOR(S) : Hatori et al.

It is certified that error appears in the above-identified patent and that said Letters Patent is hereby corrected as shown below:

Title page, Item [54] and Column 1, line 1,
Title, should read:
-- [54] IMAGE FORMING APPARATUS PROVIDED WITH A TONER PASSAGE OUTLET SEALING MAGNETIC FIELD --

Signed and Sealed this

Twenty-eighth Day of October, 2003

JAMES E. ROGAN
*Director of the United States Patent and Trademark Office*